US005998753A

United States Patent [19]

Darchis et al.

[11] Patent Number: 5,998,753

[45] Date of Patent: Dec. 7, 1999

[54] MACHINE FOR SORTING OBJECTS SUCH AS POSTAL ENVELOPES

[75] Inventors: Pierre Darchis, Nantes; Laurent Baufreton, Les Sorinieres, both of France

[73] Assignee: La Poste, Exploitant Public, Boulogne Billancourt Cedex, France

[21] Appl. No.: 08/981,485

[22] PCT Filed: Jun. 28, 1996

[86] PCT No.: PCT/FR96/01011

§ 371 Date: Mar. 11, 1998

§ 102(e) Date: Mar. 11, 1998

[87] PCT Pub. No.: WO97/01398

PCT Pub. Date: Jan. 16, 1997

[30] Foreign Application Priority Data

Jun. 29, 1995 [FR] France ..... 95 08022

[51] Int. Cl.[6] ..... B07C 5/00

[52] U.S. Cl. ..... 209/584; 209/587; 209/902

[58] Field of Search ..... 209/584, 583, 209/587, 700; 271/11

[56] References Cited

U.S. PATENT DOCUMENTS

| | | | |
|---|---|---|---|
| 2,894,626 | 7/1959 | Mulders et al. | 209/900 |
| 3,231,264 | 1/1966 | Oleinik | 271/11 |
| 3,511,368 | 5/1970 | Kajitani et al. | 209/900 |
| 3,782,541 | 1/1974 | Wood | 209/584 |
| 3,791,516 | 2/1974 | Tramposch | 209/587 |
| 4,250,028 | 2/1981 | Talyzin et al. | 209/583 |
| 4,328,962 | 5/1982 | Akers . | |
| 4,507,739 | 3/1985 | Haruki et al. | 209/584 |
| 4,509,735 | 4/1985 | Kosner | 271/11 |
| 5,143,225 | 9/1992 | Rabindran et al. . | |
| 5,593,044 | 1/1997 | Yamashita et al. | 209/900 |
| 5,755,336 | 5/1998 | Rudy | 209/900 |

FOREIGN PATENT DOCUMENTS

| | | |
|---|---|---|
| 0 407 795 | 1/1991 | European Pat. Off. . |
| 1563001 | 4/1969 | France . |
| 2181523 | 12/1973 | France . |

*Primary Examiner*—William E. Terrell
*Assistant Examiner*—Joe Dillon, Jr.
*Attorney, Agent, or Firm*—Young & Thompson

[57] ABSTRACT

A sorting machine with a standard operator work space containing a compact and ergonomic assembly of a hopper (5) for a horizontal stack of envelopes (3) between a control panel (6) and an extraction head (9), and a set of pigeonholes (11) for receiving a large enough number of sorted envelopes to prepare a postman's round. The pigeonholes are arranged above the hopper and supplied by a conveyor moving along a path in such a way that the orientation of the envelopes remains the same as they are delivered from the hopper (5) to the pigeonholes.

16 Claims, 11 Drawing Sheets

PULSE GENERATOR
COUNTER
PHOTOCELL
CAMERA
COMPARATOR
DISTANCE CONVERTOR
ALLOCATION DEVICE
READING BOARD
MONITOR AND CONTROL MODULE
CONTROL DEVICE
A
B 173
11'
188
11'
165
165
166
166
190
P
166
166
182
183
184
37
180
182
181
177
179
180
178
13'
176
174
14
13'
15
172
185
187
186
189
102
171
101
171
103
175
13
-5-

186
185
174
175
189
102
13
37
103

MACHINE FOR SORTING OBJECTS SUCH AS POSTAL ENVELOPES

BACKGROUND AND SUMMARY OF THE INVENTION

This invention relates to a machine for sorting objects flat in shape, such as postal envelopes for instance; whereby the sorting operation is performed according to criteria related to the nature of these objects: indexing code, morphology, all kinds of marking, or according to a simple counting.

This invention relates more especially to a sorting machine designed particularly for preparing and scheduling the postmen's round.

Usually, all those operations consisting in preparing a postman's round are performed manually, most of the time by the postman himself who, to this end, has a work station provided with pigeonholes which he uses to sort the mail.

This invention provides a sorting machine, similar to office equipment, and designed more especially to improve the quality of service, of productivity, by automating the mail processing tasks.

This machine may notably be ideal for instance for sorting and pigeonholing small format mail, ranging between 90×140 mm and 165×235 mm with maximum thickness of 7 mm.

The mail can be sorted using the indexing code affixed on the envelope in the form of fluorescent sticks, and according to the conventional principles of fragmented sorting and of reverse sorting.

The machine according to the invention may find many applications. Indeed, it can be suited to sorting and selection criteria adapted to objects other than simple mail, such as bundles of cheques or documents of all kinds liable to be inserted in addition to the postman's round.

The machine according to the invention also benefits, because of its contemplated application, from a compact architecture and a particularly ergonomic arrangement in order to facilitate the operator's work.

This machine comprises, generally:—a hopper to receive the stack of envelopes to be sorted,—an extraction head to pick up the envelopes one by one from one of the ends of the stack,—a conveyor interposed between the said extraction head and the pigeonholes of the sorted envelopes,—a device for locating and reading the sorting criterion, that is to say the indexing code, most of the time,—a junction system in order to direct the envelopes toward the said pigeonholes according to their indexing code and—a control panel. As this machine is more particularly suited for preparing and scheduling the delivery rounds, it shows a peculiar architecture and it comprises particularly, arranged in a compact and ergonomic fashion, in the standard operator work space:

a hopper located at standard table height in the front section of the machine, in order to receive the stack of envelopes which is placed horizontally and extends to form a facade between the control panel and the extraction head, a set of pigeonholes for sorted envelopes, whose number is sufficient for the preparation of a postman's round, whereby the said pigeonholes are located behind the transparent panel, behind one another, horizontally and on several levels, above the level of the hopper and slightly retracted in order to enable easy pick-up of the sorted envelopes located in the said pigeonholes, in order for instance to position them again in the hopper for a new sorting sequence, whereas the pigeonholes are supplied by a conveyor whose path is such that the sorted envelopes are inserted into the said pigeonholes according to an orientation corresponding to that they have in the hopper at the departure of the said conveyor.

According to a preferred arrangement of the invention, the machine comprises:

a conveyor whose speed can the adjustable, which enables to forward the envelopes widthwise, from the hopper where they are stacked to their pigeonholes and,—means for reading the indexing code according to a parallel mode taking into account that the indexing sticks are oriented in the same direction as that of the motion of the said envelopes.

This particularity relating to the conveying mode enables to improve the sorting speed; indeed the number of envelopes per linear meter is greater that when the envelopes are conveyed widthwise. When changing directions, it is also possible to accept small diameter drums, smaller than 200 mm for instance.

Besides, the reading system in the parallel mode accepts perfectly very high speeds, further notably to the very quick acquisition of the indexing code in its entirety.

This conveying mode also enables to reach the degree of compactness necessary to a machine designed for offices. As the density of objects to be sorted per linear meter is rather large, it is possible to reduce to the maximum the pitch of the junctions and consequently to have a larger number of pigeonholes available for sorting.

Still according to the invention, the indexing code reading system of the envelopes comprises:—a source for energising the fluorescent sticks which have been arranged on the address side of the envelope, whereby the source is made of a halogen lamp type light box, provided with filters in order to restrict the beam transmitted to the usefull spectrum,—means in the form of optic fibre bundles used to perform an anamorphosis between the circular output of the said light box and a lighting zone located at the level of the reading window arranged on the conveyor and whose sizes correspond at least to those of the frame containing the sticks on the envelope,—a camera comprising a CCD bar composed of several hundred pixels and especially elongated type pixels in the forwarding direction of the sticks and whose length is in the order of three times the width.

Still according to the invention, the reading system comprises means for self detection of the presence of an envelope in the reading window, whereby the means are preferably made of a fixed screen arranged at the level of the window, behind the conveying line, whereas the screen supports a reflector which, lit by the energising source of the envelopes' sticks, provides with an image which indicates the absence or the presence of an envelope, and then enables to start reading the code, if needed.

According to an alternative, the screen comprises at least one light-emitting diode whose image is received by the camera if no envelopes are present.

This self-detection system also enables to provide with information regarding the morphology of the envelope or of the object, e.g. its height, and enables to sort the objects according to their height.

According to another alternative, the screen comprises two light-emitting diodes, at a transversal distance from one another. This particularity enables to detect the position of the envelopes in the conveyor, when passing in front of the camera. Processing the information in question enables to orientate automatically the uncertain envelopes towards a rejection or recycle pigeonhole.

Still according to the invention, using several light-emitting diodes arranged transversally in front of the camera may allow to select objects, envelopes or others according to a length criterion.

Still according to the invention, the machine comprises a system for monitoring and controlling various mechanisms, which operates according to a data transmission mode in standard numeric form, whereby the system comprises:

computer-aided means for memorising the sorting plane, e.g. the destination of the objects, envelopes or others, according to the selection criteria and, whereas the destination corresponds to a pigeonhole on the machine, computer-aided means for processing information from the code reading head, in order to ascribe a location to the objects and especially to the envelope, according to its code, that is to say to ascribe to it the destination materialised by a pigeonhole, and this as soon as the object has passed in front of the reading head, computer-aided means enabling to convert the location especially the number of the pigeonhole, into the distance to be run in order to reach the pigeonhole, an optic encoder type pulse generator, associated with the envelope conveying system which enables to determine the distances run, a device for triggering the pulse countdown, such as a photocell, located slightly downstream of the reading head, a comparing device which enables to direct the object towards the appropriate pigeonhole, when the number of pulses counted corresponds to that which enables to reach the pigeonhole ascribed to the envelope.

The monitoring and control system of the machine advantageously simplifies considerably the forwarding process of the envelopes towards their pigeonholes, and this simplification is due to the compactness of the machine and especially to the distance, relatively small, which is run by the envelopes once their code has been read. The variation risks between the theoretical distances calculated by the computer and the distances actually run by the envelopes are consequently very limited.

The general architecture of the machine also enables easy handing of bundles of letters, as well as for parcels to be inserted into the hopper as for the parcels already sorted in order to put them back into the hopper. The configuration of the pigeonholes also enables, in case of successive sorting operations, to position quite easily, without any risk of mistake, the parcels, which have already been sorted.

The sizes of the machine can be selected according to the requirements. The pigeonholes of the sorted envelopes can extend over several levels, two or three for instance and the number, horizontally, may, thanks to a certain modularity of the machine, range between 10 and 30 for example. Thus it is provided with 20 to 90 pigeonholes according to the situation required.

The reliability and the efficiency of a sorting machine depend directly on the efficiency of each device it contains. First of all, they are linked to the quality of the stack placed in the hopper.

Whether small format envelopes, flat objects or cheque forms, these objects must be positioned with a great accuracy into the hopper in order to be then extracted, conveyed, decoded and then channelled towards the pigeonholes.

In order to produce a very high quality stack, let alone perfect, without calling for excessive operator's attention or rigour, the hopper according to the invention comprises—a bearing plane on which rests a large side of each object, of each envelope, and—a base or reference plane, arranged as a shoulder, and on which rests a small of the envelope, whereby the said planes form a dihedron whose edge is horizontal, whereby the dihedron is tilted in order to make the mean diagonal of the envelopes spectrum, extending from the edge of the dihedron, match the vertical axis.

This hopper enables advantageously natural positioning of the envelopes or objects to be classified onto both reference planes; indeed, these envelopes tend to bear on both these planes by their own weights.

According to another embodiment of the invention, the length of the hopper is such that it may receive at least the equivalent of a postman's round, e.g. approximately 1500 correspondence envelopes. The hopper extends preferably on the larger section of the machine, beneath the pigeonholes. But it can also contain a portion, which is static, where the envelopes are simply positioned in waiting, and a dynamic section, where the envelopes are moved towards the extraction head. This dynamic hopper comprises:—conveyor belts with endless tapes, mounted on free cylinders and whose active sides make up the walls of the base and bearing planes and,—a pusher guided on a rail parallel to the said belts which tend to move automatically the active edges and the stack of envelopes toward the extraction head, whereby the pusher is connected to means which maintain substantially constant a pressure between the stack and the envelopes extraction head.

Still according to the invention, the pusher actuation means comprise of a traction cable which is anchored at one of its ends on the pusher and which is provided, at its other end, with a weighting body moving vertically, whereby the weighting body comprises a primary mass moving vertically over a distance which corresponds to half that of the pusher, and a plurality of small masses spaced vertically on the end of the traction cable between the said primary mass and a resting surface on which they land as the length of the envelopes stack diminishes in the hopper.

The quality of the sorting operation also depends on the regularity of the train of envelopes, conveyed towards the reading head. This train of envelopes is produced at the output of the hopper using the extraction head and which may attain the speed of 20 envelopes per second.

The envelopes can the extracted at either end of the hopper. As the envelopes maintain the same direction in the hopper, de-stacking is performed either on the facade or the back of the envelope. De-stacking on the back of the envelopes enables to detect and to process more easily tiling phenomena while orienting the envelopes affected towards particular pigeonholes from which they will be re-processed at a later stage.

According to the invention, the extraction head comprises an endless tape, motorised and punched, which emerges in a suction window arranged at the level of the wall making up the end of the hopper, whereas the window is located upstream of the conveyor in such a way that the distance between the active upper section of the window where the envelope starts to be sucked up, and the zone where the envelope is picked up, driven by the punched tape, be smaller than the minimal size of the envelopes according to their direction when they are extracted from the hopper by the punched tape.

Still according to the invention, the envelopes are picked up at the output of the extraction head, by a pinching effect and energetically by the active edges of a pair of belts which are part of the conveyor, whereas the belts are arranged in the alignment of the punched tape of the extraction head, forming a kind of funnel centered around the middle axis of the said tape according to the forwarding direction, in order to maintain the envelopes into the proper direction as they are extracted from the hopper and in order to prevent a torque effect, e.g. to prevent the envelopes from tipping over or pivoting.

According to another embodiment of the invention, in order to prevent several envelopes from being extracted, the punched tape of the extraction head works together with a separating device arranged at the level of the downstream end of the hopper, whereas the said device comprises a drawer which is mobile, guided into a direction which corresponds to the forwarding direction of the stack, whereby the drawer is connected to a bracket mounted at the bottom of the hopper and comprises:

a stop in the form of a plate extending into the bottom of the hopper, located slightly beneath the bearing plane of the envelopes, a flexible tongue, made of high friction coefficient material, arranged beneath the stop, in order to retain the envelopes which might have escaped from the latter, the drawer is pushed elastically and permanently towards the punched tape and retracts automatically when an envelope passes and is driven by the punched tape clue to a depression effect, whereby the brackets of the drawer are preferably articulated around an axis perpendicular to the forwarding direction of the stack in order to enable its retraction, in the space located at the end of the hopper, in anticipation of adjustment or replacement of the said tongue or possibly to facilitate the access to this zone in case of incidents such as jamming.

According to another embodiment of the invention, the endless punched tape of the extraction head has a length greater than the perimeter of the extraction head in order to enable it to pass around the head and to facilitate any change or replacement, whereby the tape is stretched and guided over rollers and according to a U-shaped path, whereby the roller guiding the tape at the bottom of a U-shaped path can be removed in order to release the tape, after release of the tension device.

According to another embodiment of the invention, the envelope conveying line comprises:

a first conveyor arranged downstream of the extraction head, which picks up the envelopes at the output of the said head and in which these envelopes move along a line which is located on a plane parallel to the base plane of the hopper, a second conveyor, arranged behind and in the clearance of the hopper, constituting a twisting module and enabling the envelopes to switch from moving on a plane parallel to the base plane of the hopper to moving on a plane which is vertical and parallel to the front of the machine, an intermediate conveyor extending from the twisting module up to the reading head which brings back the envelopes onto a side of the machine, a junction and distribution conveyor, comprising a vertical portion on the side of the machine and then extending horizontally, so as to form a facade on the machine, in order to supply at least one of the horizontal lines of pigeonholes, whereas the conveyors are generally made, with the exception of the twisting conveyor, of several belts distributed over the width of the machine, guided over small diameter rollers or cylinders in the rectilinear portions and over small diameter drums at the turning points, whereas the belts enable to transport the envelopes by pinching between the active sizes of two belts arranged opposite one another forming on either of the path of the said envelopes an internal wall and an external wall, whereby the transversal distance between the belts is smaller than the dimension of the great side of the smallest envelope, in order to forward the envelopes inside the machine, widthwise.

According to another embodiment of the invention, each conveyor comprises preferably non-extensible driving belts while the driven belts are made of a more flexible material in order to absorb any possible thickness variations of the envelopes, without disturbing the driving process, whereas the driving belts are preferably arranged inside the curves in order to limit the traction and deformation loads exerted onto the back of the envelopes.

Still according to the invention, the conveying line of the first conveyor comprises :—an internal wall made of endless belts, spaced and stretched between an intake suction cylinder located beneath the extraction head, and a downstream cylinder located at the level of the twisting module passing over a drum, whereas one of the belts is located in the alignment of the punched tape of the extraction head, and,—an external wall made of endless belts arranged opposite those of the external wall and which are only stretched between the drum and a downstream cylinder on the one hand, and a simple endless belt, arranged in the alignment of the punched tape of the head, on the other hand, opposite the belt of the internal wall, stretched between the said drum and an upstream roller located at the level of the extraction head beneath the end of a hopper.

According to another embodiment of the invention, the twisting module is made of a small diameter circular section endless belt, interposed between the first conveyor and the intermediate conveyor, in order to form a continuity, whereas the belt is supported by rollers and works together with pressure devices constituting one of the walls of the guiding path, whereby the devices are similar to castors of flexible material, forcing against the belt at the level of the rollers, the assembly formed by the belt and the flexible castors thus guiding and maintaining the envelopes along a longitudinal axis, on the side of their base edge, the other of the said envelopes being simply guided using smooth fixed rails interposed between the downstream section of the first conveyor and the upstream section of the intermediate conveyor.

Still according to the invention, the intermediate conveyor extends between the twisting module and the junction conveyor and comprises, on its path, according to one of the embodiments, a re-jogging device working together with the corresponding to the base edge of the envelope, whereas the said device is constituted of a wall perpendicular to the circulation plane of the envelopes, arranged on the of the edge belts of the said intermediate conveyor, whereby the re-jogging wall comprises an upstream section converging toward the said belts and a downstream section rigorously parallel to the edge belts in order to progressively lift up the said envelopes which might have been arranged slantwise, incidentally, on the said conveyor, whereas the envelopes can be lifted up because they can pivot when they are pinched between the edge belts, while the other belts of the conveyor are kept under pressure or pulled away from one another in order to release the other side of the envelope, over the length of the path which corresponds substantially to the length of the re-jogging device.

Still according to the invention, the re-jogging wall is made of a simple sheet or of an endless tape which travels at the same speed as the envelopes.

According to an embodiment, the re-jogging device is arranged upstream of the twisting module, integrated to the first conveyor, in its downstream section.

According to one of the embodiments of the invention, the junction conveyor comprises a primary junction in order to supply two conveying and distribution lines, whereas the lines are superimposed, parallel to one another and extend to form a facade in order to supply two levels of pigeonholes, whereas the upstream primary junction is arranged in the vertical lateral section of the machine, on the extraction head side and comprises:—a rectilinear path in the alignment of the downstream section of the intermediate conveying line, to supply the upper conveying and distribution line and,—a slightly tilted path, oriented toward the lower conveying line and distribution line, whereby orientation toward the lower line is made using a deflecting device constituting the junction, whereas the device is actuated by appropriate electromagnetic means.

According to another embodiment, the junction conveyor can be shared into three conveying and distribution lines of the envelopes, whereas the lines are horizontal, superimposed, each corresponding to a set of pigeonholes; the said lines are supplied by two primary junctions arranged in the vertical side of the conveyor.

Still according to the invention, each conveying and distribution line comprises:—endless belts spaced transversally, forming the upper wall, stretched and guided by cylinders and,—endless belts delineating the lower wall, guided over cylinders, whereas the lower belts are separated by windows to allow the passage of envelopes whose sizes are suited to the format of the latter, whereas the envelopes are oriented toward the appropriate pigeonholes using a junction device designated hereafter deflecting device, which deviates the envelope from its horizontal rectilinear normal path in order to orient it downward, guided at first by a fixed plate deflector, then by a flap which on the one hand, transports the envelope to a truly corresponding pigeonhole and, on the other hand, contributes to forming a tidy or sequenced stack, in the pigeonhole.

Still according to the invention, each deflecting device is arranged opposite the deviated line with respect to the rectilinear conveying line; it is actuated by an electromagnet and comprises a wall which is mobile around an axis perpendicular to the forwarding direction of the envelopes, between an inactive deviation position which enables the envelopes to follow a rectilinear path and an active deflecting device position causing the envelopes to change direction, whereby the deviator wall is constituted by the upstream face of small inertia parts, arranged transversally, over the width of the conveyor, between the belts.

Still according to the invention, the tip over axis of the deflecting device is arranged downstream of its deviation wall, above the conveying line of the envelopes. It is substantially centered in the plane forming with the deviation wall, when the latter is in active position, a dihedron whose edge is on the conveying line and whose bisecting plane corresponds to the horizontal conveying line; this position of the tip over axis prevents, when the envelope bumps into the wall, from causing any torque which might oppose the motion of the deflecting device. This axis is also positioned to enable quick return of the deflecting device to an inactive position as soon as the leading edge of the envelope is picked up by the fixed deflector, whereby the quick return is made possible because the delecting device is not subject to any return load.

This very quick return of the deflecting device advantageously, in case of envelopes tiling, lets the second envelope go into a pigeonhole designed for receiving the refuse; this pigeonhole can be arranged for instance at the end of the conveying line. This suppresses any risks of pollution or mistake in the pigeonhole into which the previous envelopes was channelled.

According to another embodiment of the invention, the flap of each pigeonhole is articulated at its upper section by an axis arranged beneath the level of the fixed deflector and beneath the upper section of the said flap in order to give to the latter, when the envelope bumps into the upper section, a pulse causing the flap to rotate around its axis in order to lift up quickly the envelope which had been sent to the bottom of the pigeonhole, thus creating immediately a space between the envelope and the flap in order to accommodate the following envelope which will be then positioned in a tidy or sequenced fashion, in the pigeonhole situated behind the previous envelope, with no risk of been inserted inside the stack which is formed in the pigeonhole in question.

Still according to the invention, the external belts of the distribution paths are guided at their downstream end by a tension device, whereas the device can be disengaged so that the external and internal belts may be sufficiently slack to facilitate any intervention in case of jamming or other incidents.

According to another embodiment of the invention, the external belts of the distribution paths are forced against the internal belts by rollers arranged between the guiding rollers the said internal belts, in order to initiate of motion tending to lift up the leading edge of the envelopes and to facilitate the passage across the junction windows whereby the pressure rollers are preferably combined two by two by arms forming a kind of bogie articulated on the axis of a roller which supports the inactive side of the external belt.

Still according to the invention, the pigeonholes of the sorted envelopes are arranged in the form of baskets, whereas the baskets are supported by brackets which enable to remove them directly from the front, each basket comprising for instance five pigeonholes and each pigeonhole corresponding to a handful of some 120 envelopes, the baskets being preferably two in number for each level and each level comprising in addition to the baskets, a fixed additional pigeonhole to accommodate the sorting refuse; this additional pigeonhole being arranged at the end of the conveying and distribution line.

BRIEF DESCRIPTION OF THE DRAWINGS

The invention will be detailed using the following description and the appended drawings, given for exemplification purposes, and on which.

DESCRIPTION OF THE PREFERRED EMBODIMENTS

Figure 1:
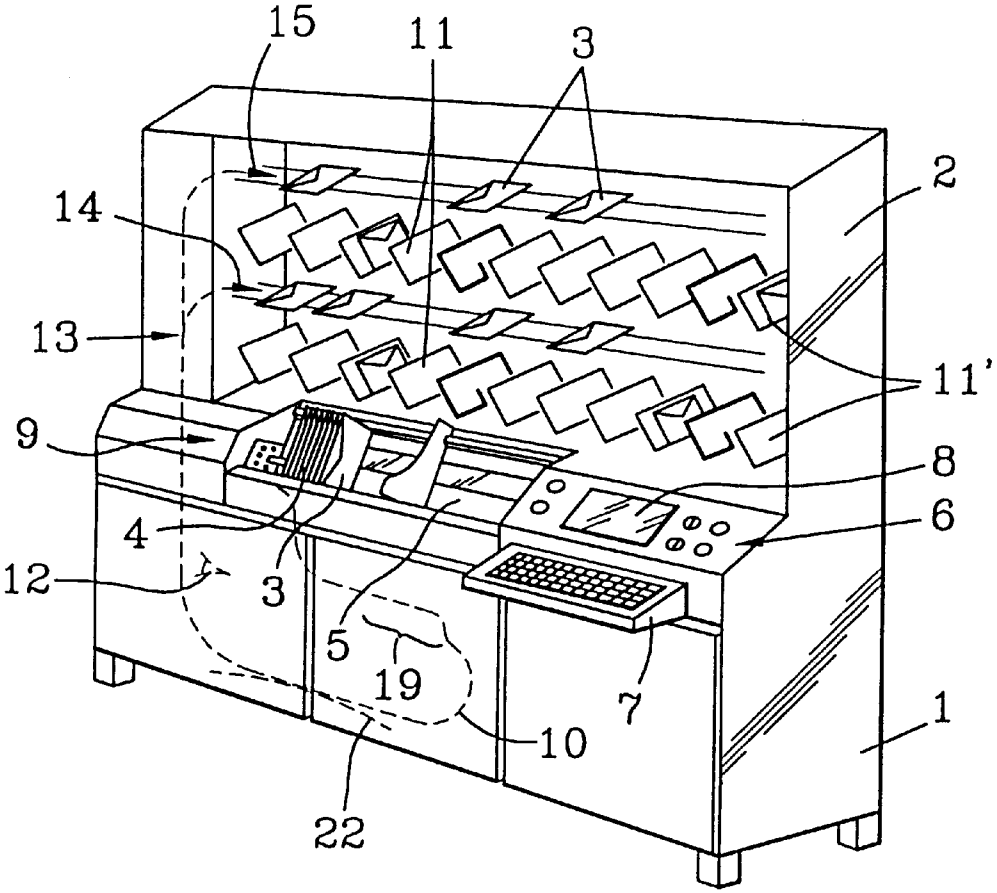
FIG. 1 is a perspective and diagrammatical view of the sorting machine according to a first embodiment of the invention.

The machine represented on FIG. 1 is constituted of a base 1 comprising the main devices, with a body 2 mounted on the top and open to form a facade. The sizes of this machine correspond to those of an office machine: the height of the base 1 corresponds to a normal table height, e.g. approx. 90 cm; the overall height of the machine ranging from 1.80 to 2 m and the width being approximately 2 m. It may also be mounted on castors in order to be moved more easily.

This machine is arranged so that the operator can manipulate these various devices in his standard workspace.

Indeed, the operator intervenes to insert the envelopes 3 either in the form of packets or of stacks 4, in a hopper 5 which is arranged in the upper front and central section of the base 1.

The dimensions of this hopper 5 have been selected so that it can accommodate horizontally at least one stack of envelopes, which corresponds to a standard postman's round, e.g. a stack of approximately 1,500 letters or envelopes. These envelopes can be of machine-processable conventional small format with sizes ranging from 90×140 mm to 165×235 mm.

This hopper can also accommodate, besides these envelopes, various flat objects such as cheques or documents whose format corresponds to that of the envelopes and whose thickness is limited at approximately 7 mm maximum. The length of a hopper ranges from 1 to 1.2 m minimum for instance.

On the right of the hopper 5, on FIG. 1, it is provided the control desk 6. A keyboard 7, positioned for instance to form a facade, in a drawer, enables to perform maintenance operations on the machine.

The control desk or station 6 also comprises a monitoring screen 8, on which the operator can follow the selection of his sorting programmes or other programmes.

On the other side of the hopper 5, on the left on FIG. 1, it is provided the extraction head 9 located in the upper section of the base 1. This extraction head enables to drive one by one the envelopes 3 arranged in stacks in the hopper 5 in order to forward them, via a conveyor 10, toward the pigeonholes 11 arranged in the body 2, above the hopper 5.

The operator intervenes at the level of the hopper 5 to insert the packets or the stack of envelopes; he intervenes at the level of the control desk 6 and at the level of the pigeonholes 11 to collect the packets of envelopes thus sorted.

The envelopes 3 are forwarded toward the pigeonholes 11 and they are positioned in the pigeonholes 11 according to a preset order, in relation to their indexing code, whereas the code is scanned by a reading head 12 arranged, as represented on FIG. 1, at the lower section of the lateral ascending side of the conveyor 10, beneath the extraction head 9.

The envelopes 3 are positioned in a certain way in the hopper 5. It should be noticed that the front face of these envelopes is oriented toward the extraction head 9. The distance travelled by these envelopes 3, using the conveyor 10, is such that, in the pigeonholes 11, the envelopes 3 maintain the same orientation and the same structure as a packet or stack as in the hopper 5. Thus, the operator preparing for instance his round has packets available in the pigeonholes 11, arranged in a certain order, which can be re-positioned in the hopper 5, according to the sequence of the pigeonholes 11, in order to perform a new sorting operation, for instance reverted sorting, in complete safety, and moreover with the guarantee that the envelopes will be positioned correctly in the hopper since the envelopes 3 show, at the level of the packets arranged in the pigeonholes 11, an alignment corresponding to that they have in the hopper 5.

The machine shown on FIG. 1 comprises two levels of pigeonholes 11 extending horizontally, above and retracted from the hopper 5. These pigeonholes are gathered in five to form baskets; each level comprises two baskets and, at the end, on the right of the figure, it provided refuse pigeonholes 11' to accommodate envelopes which cannot be allocated or mistakes caused by incidents during sorting.

The conveyor 10 supplies each level of pigeonholes and especially, from a primary junction 13, by conveying and distribution lines 14 and 15, each located above the corresponding pigeonholes. Both these lines are parallel to one another, as well as horizontal. The line 14 is located beneath the line 15.

Figure 2:
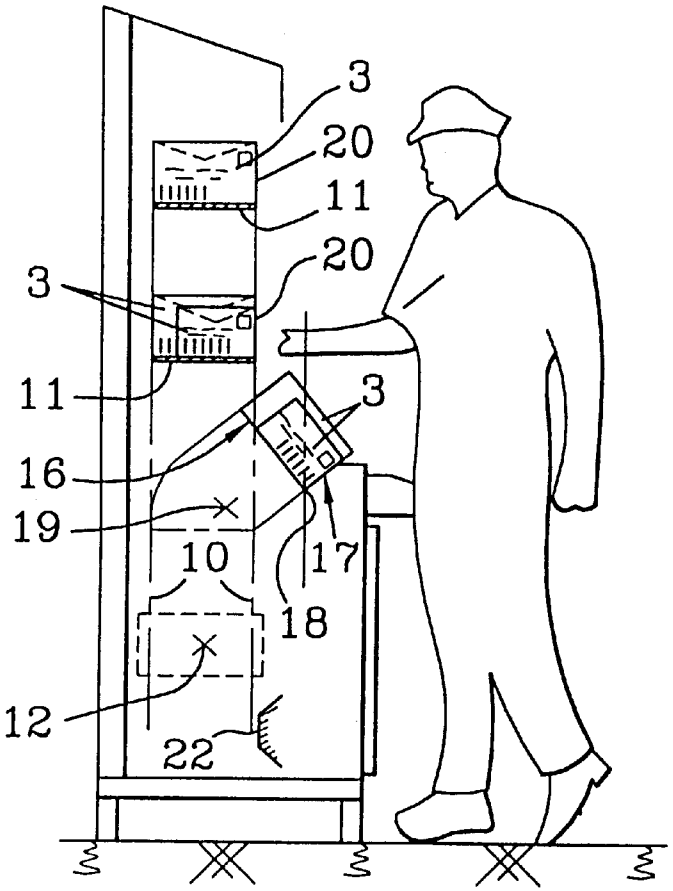
FIG. 2 is a diagrammatical and sectional view of the machine according to FIG. 1, and represents especially the path followed by the envelopes in the machine.

It should be noticed, on FIG. 2, the position of an operator in front of the machine. The operator can use the keyboard of the control desk 6 to choose and select sorting programmes. When he initiates a sorting session, the envelopes 3 which are positioned in the hopper 5 leave, one by one, on the conveyor 10.

It should be noticed that the envelopes 3 are positioned in the hopper 5 in a peculiar way. Their large lower side is positioned on a bearing plane 16 and the small side is positioned on a base or reference plane 17 which is arranged on the edge, e.g. on the side of the facade of the base 1.

Both planes 16 and 17 are mutually perpendicular; they form a dihedron whose edge 18 is horizontal and parallel to the facade plane of the machine. This dihedron is tilted in order to position the envelopes 3 in such a way that their diagonal line, which extends from the edge 18 of the dihedron, is substantially in a vertical position. The angle of the bearing plane 16 with respect to a vertical line is approximtely 37°, ranging from 30 to 40°.

This tilted hopper enables to place the envelopes directly bearing onto both planes 16 and 17, naturally, by simple gravity, without resorting to particular manipulations. Generally, the envelopes are positioned in the hopper 5 in packets. Dropping the packets into the hopper causes the envelopes to bump or jog against the planes 16 and 17.

The hopper being tilted, the envelopes 3, during extraction, must be moved along a plane which is parallel to the base plane 17.

The greater section of the conveyor 10, transferring the envelopes up to the pigeonholes 11, moves the envelopes along an axis located on a vertical plane, corresponding to the front plane of the machine. The envelopes are then lifted up in a particular conveyor designated hereafter a twisting module. This twisting module 19, detailed below, imposes a movement which enables the envelopes to switch from their displacement plane parallel to the base plane 17 to a vertical displacement plane.

The twisting module rotates the envelopes on the side of their base edge 20, e.g. on the side of their edge bearing on the base plane 17. This base edge 20 will end in the pigeonholes 11 on the operator's side. All the envelopes 3 are aligned according to their base edge 20 throughout the circuit they follow thanks to the conveyor 10, inside the machine.

It should be noticed on FIG. 2, that the envelopes 3 are oriented in the hopper 5 and in the pigeonholes 11 identically. The lower edge 21 of the envelope resting on the bearing plane 16 in the hopper 5, then rests on the bottom of the pigeonhole 11.

For reverted sorting, the operator only needs to take a packet of sorted envelopes, arranged in a pigeonhole 11 and to lower it into the hopper 5 without re-modelling the packet since the packet taken from the pigeonhole 11 exhibits a configuration identical to that it has in the hopper 5.

It should be noticed also, on FIG. 2, at the lower section of the caisson 1, a device 22, which performs automatic re-jogging of the envelopes. This device 22 which also appears as a mixed line on FIG. 1, enables to realign the base edge 20 of the envelopes 3 with respect to the plane along which they move.

It should be noticed also, on FIG. 2, the location of the reading head 12 of the indexing code, in the lower section of the base 1.

The sorting machine also exhibits relatively small space requirements as far as its depth is concerned. This depth corresponds approximately to twice the length of the largest envelope.

Figures 3, 4, 5:
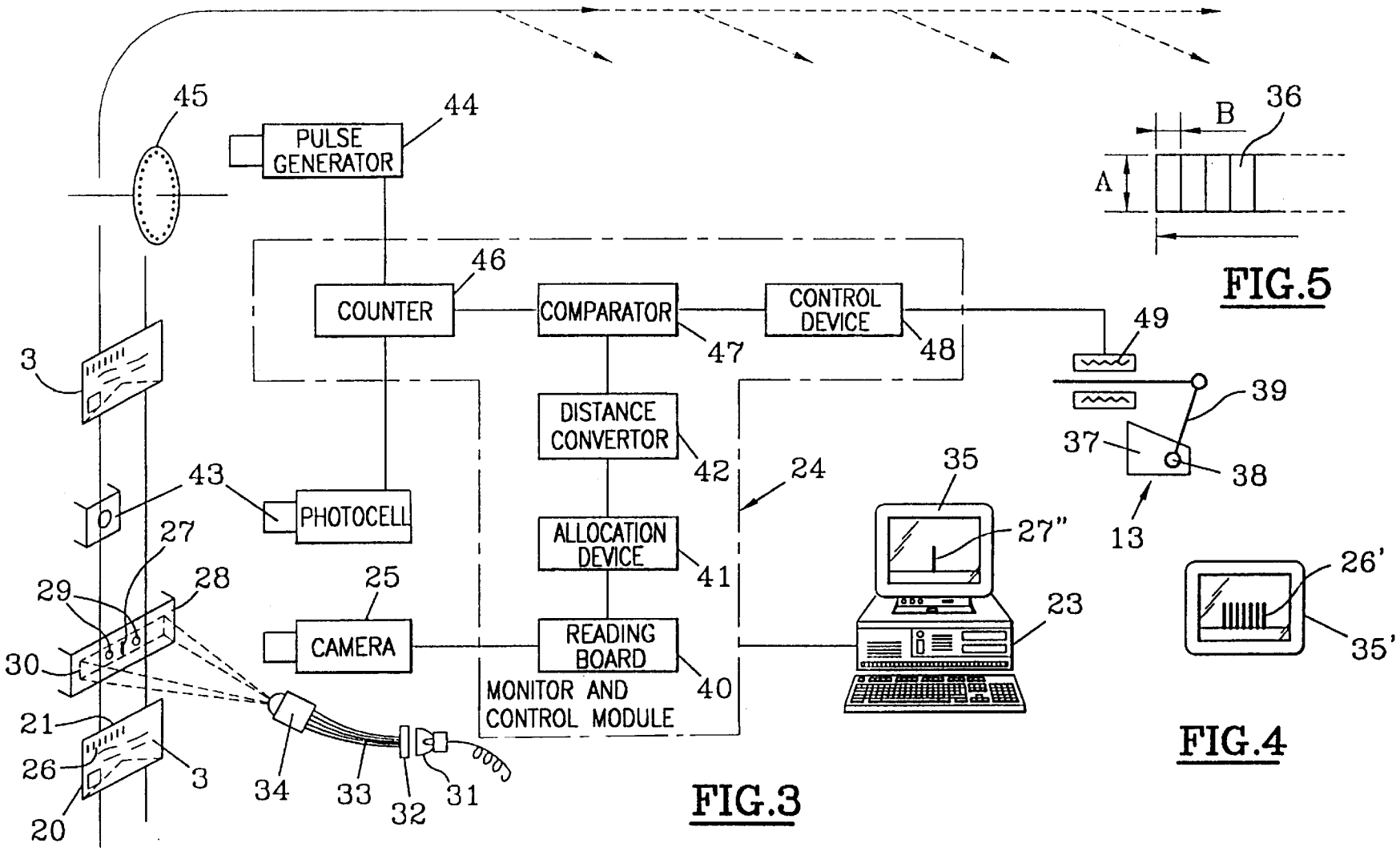
FIG. 3 represents the monitoring and control system of the machine.
FIG. 4 represents, on a screen, the image of the indexing code.
FIG. 5 represents a very enlarged portion of the CCD bar of the camera.

FIG. 3 shows the different means playing a part in the control system of the machine and whose purpose is to channel correctly the envelopes according to their indexing code.

In the case of letters, machine-controlled sorting resorts to computer-aided means which, from a previously memorised sorting plane, orientate the envelopes, in relation to their indexing code, toward pigeonholes whose numbers are associated with the sorting plane.

The microcomputer 23 is combined to a monitoring and control module 24. It prepares and stores in memory all the sorting planes liable to be used on the machine. In order to prepare his round, the operator chooses his plan on the keyboard of the control desk 6 and, when he initiates the sorting session, the envelopes leave one by one the hopper 5, pass in front of the code reader 12, are then allocated by the computer-aided processing system, an allocation which enables them to reach the appropriate pigeonhole 11, whose number corresponds to the sorting plane. Any anomaly detected when reading the code may cause the affected envelope to be directed toward the refuse pigeonhole 11'.

The sorting planes are prepared on the microcomputer 23. They consist for instance of a conversion table of the different combination ranges of streets and numbers into at least as many directions as pigeonholes 11.

As represented on FIG. 3, the envelopes 3 are conveyed inside the machine widthwise parallel to their small sides, driven by the conveyor 10. This particularity of the widthwise processing enables, with respect to a lengthwise processing, to improve the performances of the machine and to produce a small format machine.

Indeed at equal speed and at equal interval between the envelopes, the output of the machine will be notably higher.

On the other hand, considering an equal machine output, the conveying and de-stacking speeds will be smaller, which consequently offers greater operating safety.

The space requirements, lengthwise, are also smaller, which enables to maximise the architecture of the machine.

When being transported by the conveyor 10, the envelopes pass in front of the code reading device 12. This device comprises a camera 25 which captures, globally, the indexing code image made of fluorescent sticks 26 arranged normally in the lower right-hand section on the obverse of the envelope.

In the vertical side of the conveyor 10, the envelopes 3 move backwards, with their lower bearing edge 21 foremost.

If no envelope is present, the camera 25 captures the image of a reflector 27, arranged on a fixed screen 28 situated behind the conveyor 10.

Instead of the reflector 27, it is possible to provide to arrange at least one light-emitting diode 29, in the field axis of the camera 25, in order to detect in the same fashion as with the reflector 27, the presence or the absence of an envelope.

This envelope presence detection mode also enables, with appropriate computer-aided means, to determine the dimension of the envelopes or of the objects in their running direction in front of the camera 25, as well as the interval between two envelopes.

Using two light-emitting diodes 29, as represented on FIG. 3, whereas the diodes 29 are spaced transversally along a perpendicular line with respect to the conveying direction, enables moreover to determine the position of the envelope in the conveyor 10 and to detect any faulty position. Processing this information enables, if needed, to orientate the envelopes which were positioned incorrectly in the conveyor, toward the refuse pigeonhole(s) 11' in order to avoid any incidents at the level of the junctions.

Using several diodes spaced transversally may also enable to determine the transversal dimension of an envelope or of an object and to use this information as a sorting criterion.

The camera 25 captures permanently the image of an area 30, which is lit by an energising source of the fluorescent sticks 26 and of the reflector 27 according to the case.

This energising source is constituted of a light box comprising a small power halogen lamp 31. This halogen lamp 31 is provided with a filter 32 to restrict the beam generated to a useful spectrum. The beam reaches the zone 30 using a bundle of optic fibres 33 in order to produce, via appropriate optic means 34, a rectangular lighting zone whose sizes are appropriate to those of the frame in which the indexing code appears. This frame is approximately 120 mm transversally and 5 to 6 mm high.

On the screen 35 of the computer 23, it should be noticed the image 27', which corresponds to that of the reflector 27, captured by the camera 25. When the envelope 3 progresses, driven by the conveyor 10, its bearing edge 21 masks the reflector 27 or the diode(s) 29 which causes the camera 25 to scan the sticks 26 constituting the indexing code of the envelope. This image 26' is represented on the screen 35' illustrated on FIG. 4.

When the image 27' of the reflector or that of the diodes 29 vanishes from the computer, the camera 25 can read the indexing code of the envelope 3.

The sticks are scanned heightwise which corresponds to the running direction of the envelopes 3 in front of the camera 25. The camera 25 acquires globally the code image using a CCD bar. Preferably, the size of this bar is 512 pixels. It is represented partially on FIG. 5. Each pixel 36 is elongated in shape; its height A equals three times the width B, in order to improve the lighting power. As the pixels are oriented according to the running direction of the sticks, this gain at the level of image acquisition enables to use a small power halogen lamp.

The selection of a CCD bar comprising 512 pixels enables, taking into account the dimensions of the frame within which the sticks 26 are displayed, to have seven pixels available per stick pitch at the level of the indexing code on the envelope 3.

The time during which the code passes in front of the camera is thus reduced considerably. It provides with a longer time for processing and exploiting the image by computer-aided means. The ratio between the code image processing time and the reading time of the said code is very high.

FIG. 3 also represents, as a block diagram, the means enabling, once the code has been read, to actuate a junction such as the primary junction 13 which orientates the envelopes toward one of the distribution lines 14 or 15, FIG. 1. This junction 13, which is identical to those encountered on the lines 14 and 15 comprises a deflecting device 37 which will be detailed further in connection with FIG. 16. This deflecting device is mounted on an axis 38 operated by a crank 39.

The monitoring and control module 24 comprises a reading board 40, which deciphers the indexing code read by the camera 25. Computer-aided means 41 allocating the envelope whose code has just been deciphered by comparing this code with the sorting plane previously memorised.

Computer-aided means 42 establish a conversion between the location ascribed, e.g. the number of the pigeonhole designed for receiving the said envelope, and the distance over which this envelope must travel from a preset point, in order to reach the junction corresponding to this pigeonhole. This distance is sufficiently small to avoid any variations between the theoretical position and the actual position of the envelope; whereas the variations are inherent to the conveying system.

Once the envelope 3 has passed in front of the camera 25, it is detected by a photocell 43 which starts counting down pulses, whereby the pulses are produced by a generator 44 such as an optic cell encoder, which transmits pulses thanks to an encoded wheel 45 driven into rotation by the conveyor 10. A counter 46 adds up the pulses and, using a comparing device 47, the number of pulses accounted for is matched with a distance over which the affected letter must travel in order to reach the pigeonhole which has been ascribed to it. This distance is counted as pulses by the computer-aided means 42. When both values are identical the comparator 47 commands the control device 48 to actuate an electromagnet 49 which positions the junction 13 and especially its deflecting device 37, in order to orientate the envelope towards the pigeonhole which has been allocated to it.

With a conveying speed of approximately 4 m/s, the sorting output may reach 65,000 letters per hour according to the interval selected between the envelopes.

For a linear conveying speed of 2 m/s with a minimum interval of 80 mm between each envelope, the machine reaches an output of 36,000 letters per hour.

Figure 6:
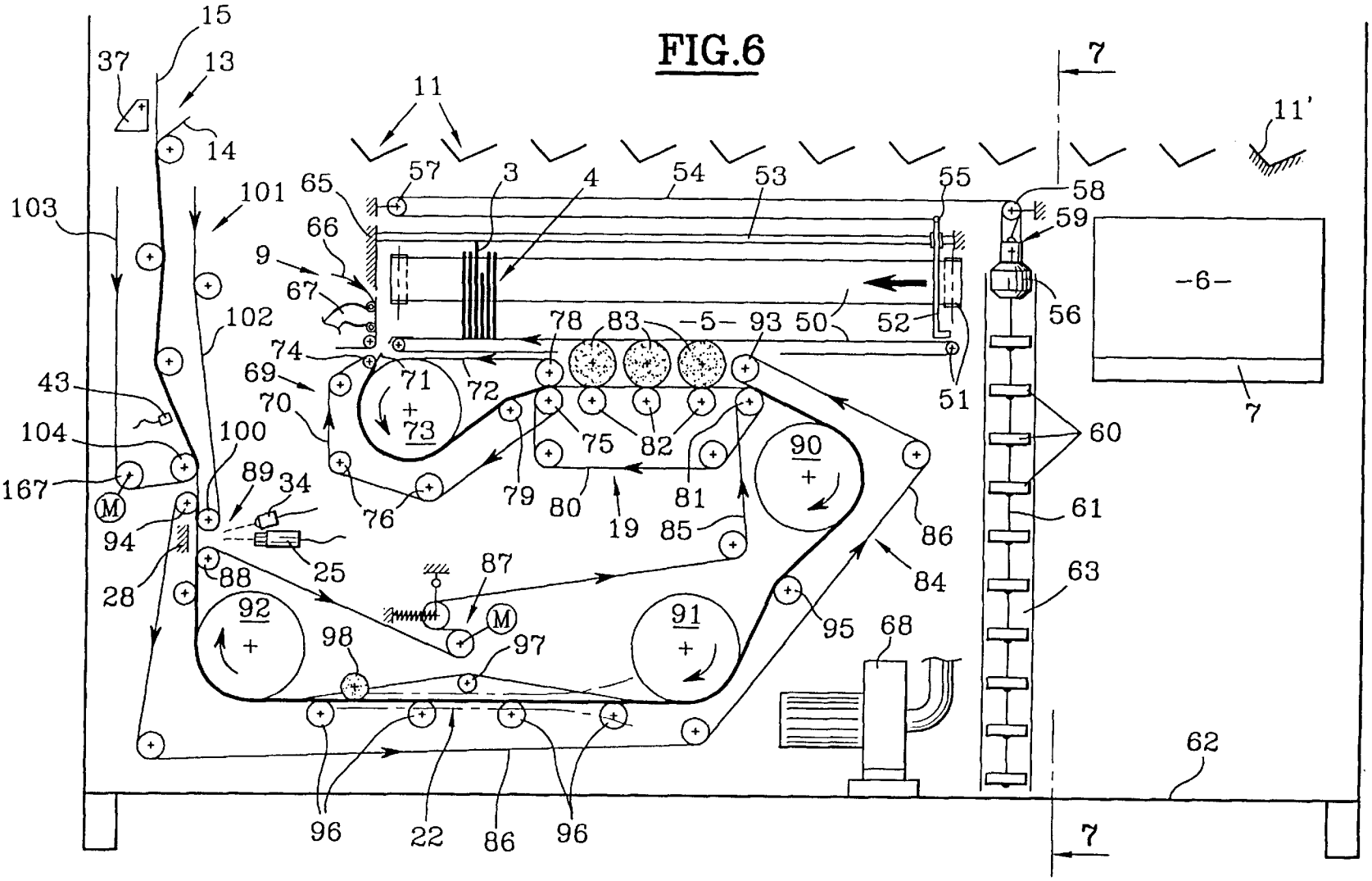
FIG. 6 is a diagrammatical representation of the machine devices, and especially of the devices arranged in the lower caisson of the machine.

FIG. 6 is a diagrammatical representation of the lower section of the machine corresponding to the base 1. This base 1 comprises the hopper 5, the lower section of the conveyor 10 represented diagrammatically on FIG. 1, as well as the control module 6 located above the keyboard 7.

The hopper 5 is represented in a more detailed way on the other figures as well. It should be noted here that the positioning of the bearing 16 and base 17 planes differs on FIG. 6 from that which can be found on the other figures and particularly on FIGS. 2 and 7. This representation has been adopted in order to show in a simple way the different devices of the machine.

The envelopes 3 are positioned in the hopper 5 on two endless tapes of the conveyor belts, these endless tapes 50 are guided at each of their ends on cylinders 51 which are free. The tapes 50 are driven directly by the pusher 52 whose purpose it is to drive the stack 4 toward the extraction head 9. The pusher 52 is guided on a rod 53, which is parallel to the tapes 50 of the conveyor belts. It is mobile under the effect of a traction cable 54 one end of which 55 is connected to the pusher 52 and the other end of which is connected to a weighting body 56. The cable 54 winds on a return pulley 57 arranged at the end of the hopper which is located on the extraction head 9 side and returns toward the other end of the hopper, guided by a return pulley 58, up to the weighting body 56. A muffle 59 can be interposed between the body 59 and the return 58.

In order to maintain substantially constant a pressure between the stack 4 and the de-stacking head 9, the traction exerted on the pusher 52 decreases as it advances.

The weight body 56 is completed by a plurality of small additional masses 60, spaced in relation to one another, and fixed on the end 61 of the traction cable. These masses 60 are deposited at the bottom 62 of the base 1, as the pusher 52 advances, and stack up one the other thereby reducing the traction load exerted on the cable 54. The different masses 60 and the weighting body 56 are guided in a vertical shaft 63 extending beneath the pulley 58 down to the bottom 62 of the base.

The extraction head 9 is arranged at the level of the end wall 65 of the hopper 5. It comprises a punched endless tape 66 which is guided on cylinders detailed below and, behind the tape 66 at the level of the wall 65, a suction nozzle 67 which communicates with a vacuum system 68 arranged at the bottom 62 of the base 1.

The extraction head 9 will be detailed below. Because of the depression, the first envelope of a hopper is stuck on the punched tape 66 which drives the envelope towards the conveying system and especially towards a first conveyor 69 which picks up each envelope 3 at the output of the extraction head.

This first conveyor 69, detailed below, drives the envelopes 3 along a conveying path or line determined by endless belts 70 spaced transversally, which constitute the internal wall of the conveying line, and belts 71 and 72 which constitute the external wall. These belts 70, 71 and 72 wind around a drum 73 and around different rollers or cylinders. The belts 70 wind around an intake cylinder 74 which is arranged just downstream of the extraction head 9 and around a downstream cylinder 75 arranged beneath the hopper, before the twisting module 19. The active sides of the belts 70 are guided over cylinders 76.

The belt 71 which is unique, as detailed below in connection with FIGS. 8, 12 and 13, winds around a cylinder 77 shown on FIG. 8, located beneath the end of the hopper 5 and around the drum 73. The belts 72, located on both sides of the belt 71, also wind around the drum 73 and around a downstream cylinder 78 located above the cylinder 75.

The envelopes 3 are pinched between the external belts 71 and 72 and internal 70. The cylinder 74 is positioned with respect to the cylinder 77 and to the drum 73, in order to exert a pressure onto the belt 71 and to pick up energetically the envelope switching almost instantaneously from a speed V1 corresponding to the extraction speed of the punched tape 66 of the extraction head 9, to a speed V2 corresponding to that of the conveyor and which equals three times the said speed V1.

The pinching effect exerted on the envelopes is also increased in the section between the drum 73 and the downstream cylinders 75 and 78 by a cylinder 79.

The conveying system identified as 10 on FIGS. 1, 2 and 3, starts with this first conveyor 69 and continues with the twisting module 19.

This twisting module 19 comprises an endless tape 80 whose section is circular and of small diameter. This belt winds around the cylinder 75 of the first conveyor and over a downstream cylinder 81 located at the same level as the cylinder 75. Between both these cylinders 75 and 81, rollers 82 which are aligned horizontally and which delineate the internal wall of the conveying line guide the belt. Above and opposite these rollers 82, it is provided castors 83 made of flexible material. The purpose of these castors 83 is to press the envelopes 3 against the belt 80 whereas the envelopes rotate or are lifted up; the envelopes so wind around the said belt in order to be carried from the conveying plane which is a parallel to the base plane 17, to the vertical conveying plane.

As mentioned previously, FIG. 6 is diagrammatical and represents an elevation view of the extraction head 9, the first conveyor 69 and the twisting module 19. These elements are in fact arranged on a tilted plane as detailed below.

The twisting module 19 is interposed between the first conveyor 69 and an intermediate conveyor 84 to enable the envelopes 3 to switch from one plane to the other.

The envelopes are pinched and maintained applied to the belt 80 on the side of their base edge 20 using castors 83. Throughout this twisting module 19, smooth rails interposed between the downstream section of the first conveyor 69 and the upstream section of the intermediate conveyor 84 guide the other side of the envelopes. These rails do not appear on FIG. 6.

The intermediate conveyor 84 comprises belts 85 spaced transversally which constitute, for their active side, the internal wall of the conveying line as well as belts 86 arranged opposite the belts 85. The active side of these belts 86 constitutes the external wall of the conveying line.

The belts 85 work together with a tension and motorization system 87 and are guided between the cylinder 81 around which winds the belt 80 of the twisting module so that the internal wall of the conveying line is continuous from the upstream cylinder 74 of the first conveyor 69 down to the downstream cylinder 88 arranged at the level of the reading window 89.

Direction changes on the conveying line are performed using the drums 90, 91 and 92, in succession. The section of the conveying line located between the drums 73 and 90 is situated beneath the hopper 5, toward the bottom of the base. The drums 91 and 92 are located at the lower section of the base 1, also to the rear.

The external belt 86 of the intermediate conveyor 84 is guided over the drums 90, 91 and 92 and over an upstream cylinder 93 arranged in correspondence with the upstream cylinder 81 and a downstream cylinder 94 arranged above the downstream cylinder 88, after the reading window 89.

Generally, the belts constituting the internal and external walls, are arranged opposite to one another in order to pinch the envelopes. This technique is used conventionally for conveying flat objects.

In rectilinear sections, it is provided one or several pressure increasing rollers. A roller or cylinder 95 is, to this end, arranged between the drums 90 and 91. The horizontal section of the conveying line, between the drums 91 and 92, is used to perform a re-jogging operation, e.g. aligning or realigning the base edge 20 of the envelopes 3.

This re-jogging device 22 consists in fact essentially of a wall perpendicular to the displacement plane of the envelopes which, in its upstream section, converges towards the conveying belts and which is parallel to the running direction of the envelopes in its downstream section. This re-jogging device 22 is represented as a thin mixed line. It should be noticed, over the length of this re-jogging device, cylinders 96 which maintain the active sides of the external belts 86. It should be also noticed, arranged halfway up the re-jogging device 22, and above the conveying line, a roller 97 lifting up the active side(s) of the belts 85 arranged at the bottom of the base 1.

Indeed, during re-jogging, the envelope is kept pinched between the side belts 85 and 86 located at the front of the base, on the side of the re-jogging device, whereas they are free, e.g. not pinched, by the belts arranged at the rear.

Accordingly, by sliding over the vertical wall of the re-jogging device 22, the position of the edge 20 of the envelope can be corrected in order to move parallel to the running direction whereas the envelope pivots between the side belts. This pivoting is performed at the level of a roller 98 exerting a pressure of the active sides of the edge belts 86 and 87: toward the downstream section of the re-jogging device 22.

The window 89, at the level of which the indexing code is read, is arranged between the downstream cylinder 88 of the belts 85 and the upstream cylinder 100 of the junction conveyor 101.

The space between both those cylinders 88 and 100 is shorter than the smallest width of the envelopes.

This window 89 exposes the envelope and especially its indexing code, to the camera 25 arranged opposite this window. It should be noticed, arranged above the camera, the lighting source 34 which energises the fluorescent sticks 26 constituting the indexing code. It should be noticed the screen 28 arranged behind the active side of the belts 87, within the framework of the window 89;

It should be noticed also, FIG. 6, the photocell 43 which detects the passage of an envelope once its indexing code has been read. This cell 43 is located at a small distance above the window 89.

The junction conveyor 101 comprises belts 102 whose active sides constitute the internal wall of the conveying line and belts 103 whose active side constitute the external wall. The belts 103 wind, and their lower section, around a cylinder 104, arranged above the downstream cylinder 94 of the intermediate conveyor 84.

It should be noticed, at the top of FIG. 6, at the level of the primary junction 13 of the conveyor 101, a deflecting device 37 which directs the envelopes towards the conveying and distribution line 14. In its inactive position, the deflecting device 37 lets the envelopes flow in a rectilinear way, toward the conveying and distribution line 15. This deflecting device 37 corresponds to those encountered on the junctions of the lines 14 and 15.

It should be noticed also, above the hopper 5, the bottom of the pigeonholes 11 in which are inserted the envelopes 3 after the junction operation which is performed on the distribution line 14.

Figure 7:
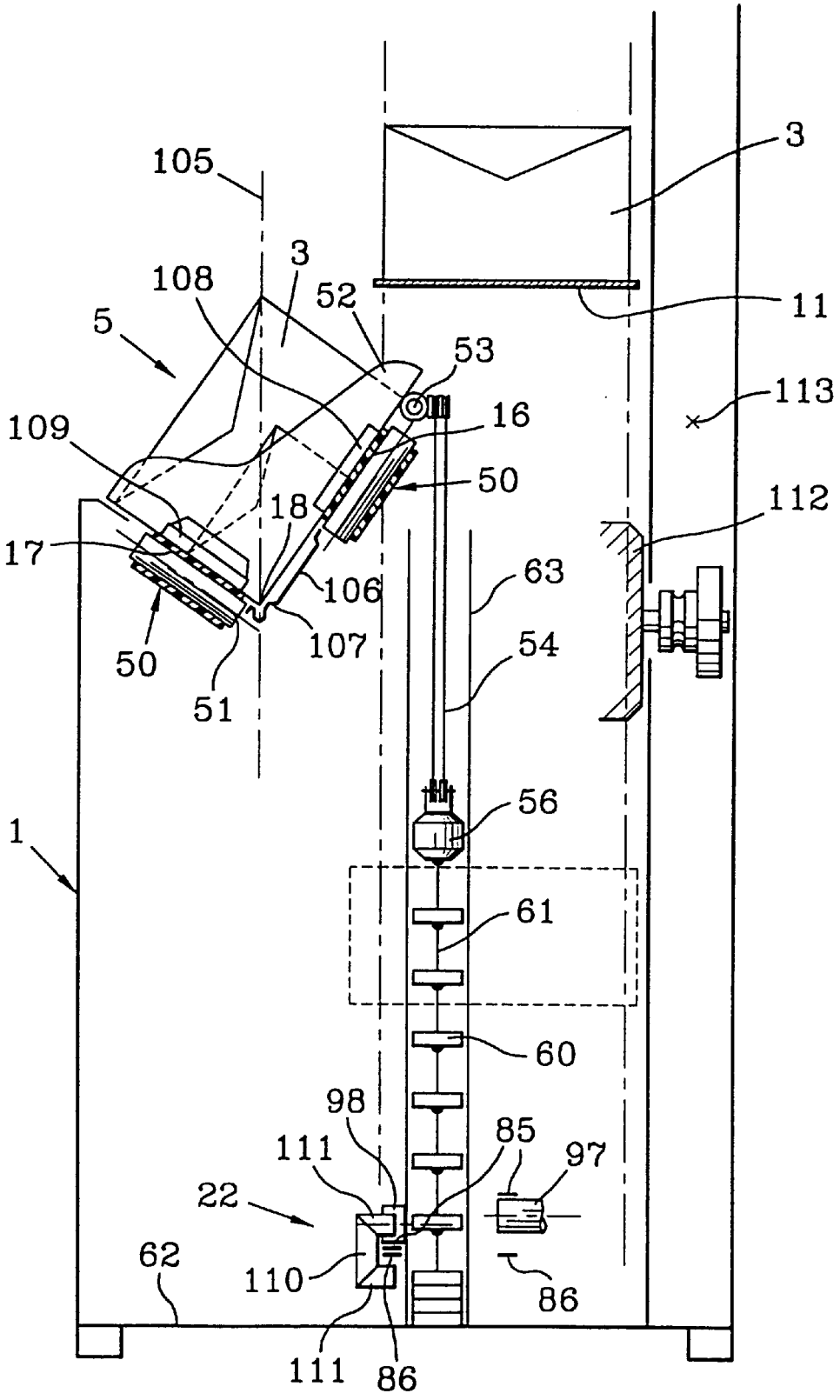
FIG. 7 is a diagrammatical and sectional view of the caisson, according to 7—7, forming the lower section of the machine.
Figure 9:
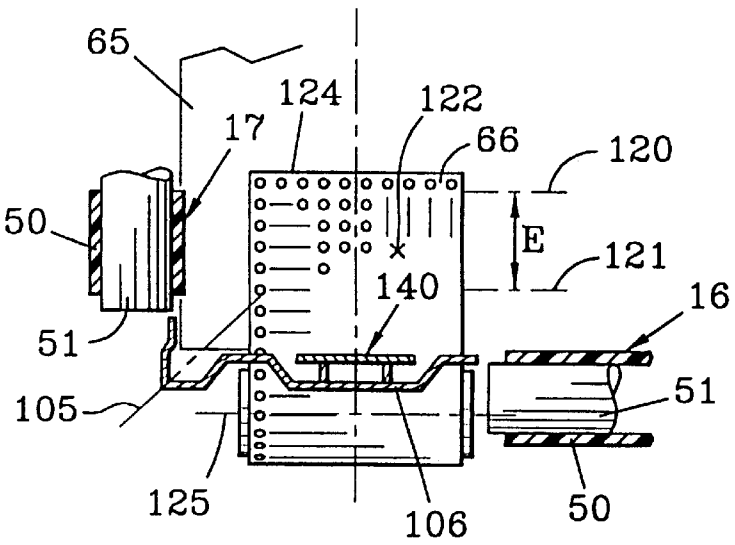
FIG. 9 is an enlarged diagrammatical view, according to 9—9, showing the extraction head.

FIG. 7 represents, in a more detailed way, the hopper 5 and its pusher 52 whose driving means are arranged in the caisson 1.

The structure of this hopper 5 is mainly composed of both conveyor belts 50 whose upper sides constitute the bearing plane 16 and the base plane 17, respectively, as represented on FIG. 2. These belts are arranged on both sides of the vertical axis 105 passing through the edge 18 of the dihedron delineated by the planes 16 and 17. It should be noticed also on this figure that the diagonal lines of the envelopes 3 are located substantially on this axis 105.

Between both these conveyor belts 50, there is a partition 106 in the form of a sheet suitably folded which comprises, close to the bottom of the dihedron, an edge 107 on which the envelopes may also bear when they have not been replaced correctly in the hopper 5.

The pusher 52 is guided over the rod 53 extending above one of the conveyor belts 50. This rod 53 is located substantially at the centre of the base 1, at its upper section. The pusher 52 comprises, in its rear section, e.g. on the side opposite the envelopes 3, blocks 108 and 109 bearing upon the conveyor belts 50. Both these blocks are weighted and are used to drive the conveyor belts 50 in relation to the displacement of the pusher 52 under the effect of the masses 56 and 60.

The masses 56 and 60, connected to the cable 54, are guided in the shaft 63 extending vertically from the bottom 62 of the base 1.

The circulation zone of the envelopes 3 inside the machine also appears on FIG. 7. This zone corresponds to the space requirements and especially to the maximal length of the envelopes to be sorted.

At the lower section of the base 1, it should be noticed especially the re-jogging device 22 constituted of a vertical wall 110 and, of two horizontal walls 111 arranged on both sides of the edge belts of the intermediate conveyor 84. It should be noticed also the roller 97 serving to pull away the belt 85 with respect to the belt 86, in order to allow lifting up the envelopes by rotation between the belts 85 and 86 located on the edge. The foam roller 98, which forces against the edge belts, is also represented. It is located at the downstream section of the re-jogging device.

The different conveyors and especially the primary conveyor 70, the twisting module 19, the intermediate conveyor 84 and the junction conveyors 101, are driven from a single electric motor 112 arranged in the base 1. This electric motor 112 is located behind the extraction head and the drive assembly of the different conveyors is gathered in a space 113 located at the rear of the machine.

It is also provided, arranged in the upper section of this space 113, all the manoeuvring means of the deflecting devices, e.g. the electromagnets 49 and their mechanism, which are examined below in connection with FIG. 16.

FIGS. 8 to 13 relate to the extraction head and to the removal of the envelopes by the first conveyor 69. This extraction head had 9 comprises a punched endless belt or tape 66, guided over rollers and especially over rollers 120 and 121 which delineate a suction window 122. It is provided behind both these rollers 120 and 121, the suction nozzle 67 linked by a pipework 123, to the vacuum system 68 represented on FIG. 6.

At the level of the suction window 122, the punched tape 66 is arranged in a plane parallel to the plane of the envelopes 3, perpendicular to the edge 18 of the dihedron forming the hopper 5 and to the running direction of these envelopes in the hopper. This suction window 122 is arranged in the wall 65, which constitutes the end of the hopper 5. It is shown as a front view on FIG. 9, through an opening 124 drilled into the wall 65. The width of this window 122 corresponds to the width of the punched tape 66 and its height is slightly smaller than the centre distance E between the cylinders 120 and 121 which are arranged upstream and downstream of this window.

Beyond the suction window 122, the punched tape 66 is guided along a rectilinear path on the same plane as that of the window to a roller 125 whose axis is located substantially at the same level as the axis of the cylinders 51 of the conveyor belt 50, whereas the conveyor belt corresponds to the bearing plane 16 of the envelopes 3 in the hopper.

Beyond this roller 125, the tape 66 extends at right angle as it moves away from the hopper 5, to a roller 126 constituting the driving roller. Another roller 127 guides the tape upstream of the roller 120. Upstream of the roller 127 is provided a roller 128 working together with a tension device 129 of the tape.

The tension device 129, similar to a gas-operated jack, is articulated on the axis 130 of the roller 128 and on the end of a rod 131, which is articulated on the axis 132 of the roller 127. In an active tension position, the axis 133 interposed between the jack 129 and the rod 131 rests on a fixed bracket 134 which enables buttressing the jack 129 and the rod 131 as well as maintaining both components in this active tension position of the tape thanks to the roller 128.

To release the tape 66, it suffices to move the articulation 133 to the other side of the line linking the axes 130 and 132 of the rollers 128 and 127 respectively.

Between the rollers 126 and 128, it is provided a last roller 135 which is arranged behind the suction nozzle 67. This roller 135 gives the tape 66 a U-shaped path; it is located at the bottom of the U.

This particularity enables, by simple disassembly of the axis 136 of the roller 135, to liberate a certain length of the tape 66, sufficient to wrap this tape easily around the extraction head 9 whose rollers 125 to 128 constitute the perimeter.

This particularity facilitates changing the punched tape or any other intervention.

Figure 10:
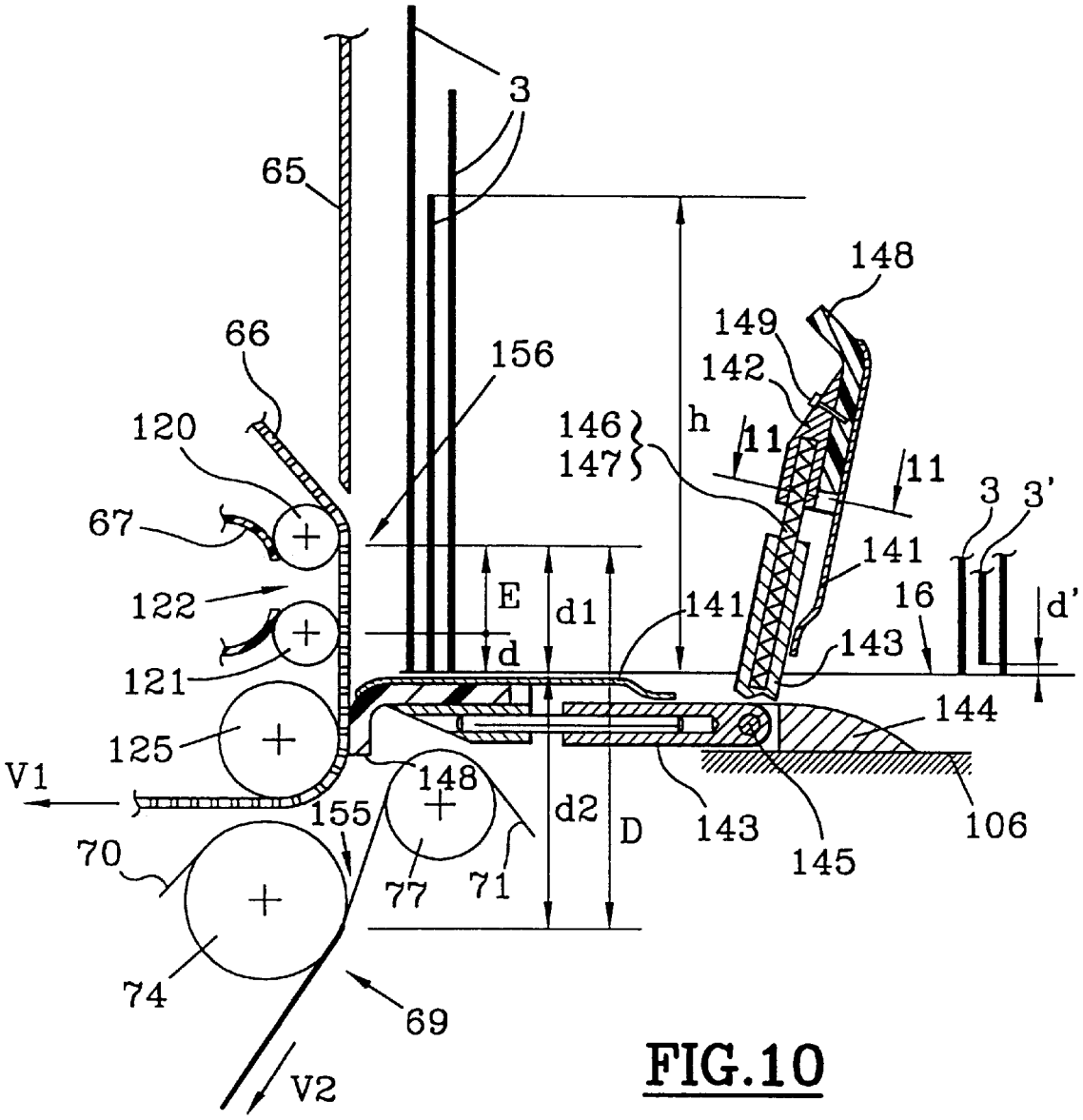
FIG. 10 represents an enlarged part of FIG. 8.
Figure 11:
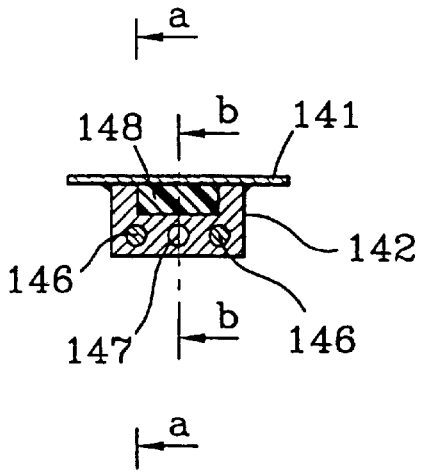
FIG. 11 is a sectional view, according to 11—11, of the separating device.

The envelopes 3 are retained in the hopper 5 using a separating device 140 which is shown more in detail on FIGS. 10 and 11. On FIG. 10, the separating device 140 is shown in active position along an a—a section of FIG. 11 and in inactive position, lifted up, along a b—b section of the same FIG. 11.

This separating device consists of a stop 141 similar to a plate extending at the level of the end of the hopper 5, in order to block the space between the end of the hopper and especially the conveying belt 50 corresponding to the bearing plane 16, and the punched tape 66. This stop 141 is connected to a drawer 142 supported by a bracket 143 connected to the bottom 106 of the hopper. The bracket 143 is connected to the bottom 106 using a part 144 fixed on the bottom 106, FIG. 10. It is articulated around an axis 145 parallel to the bearing plane 16 and perpendicular to the running direction of the envelopes in the hopper 5.

The separating device 140 can rotate around the axis 145 in order to free space at the end of the hopper and to enable an operator to perform any intervention such as a clearing a jam or making adjustments.

The drawer 142 is mobile with respect to its bracket 143. It comprises a pair of guides 146 perpendicular to the axis 145. These guides 146 are arranged, FIG. 11, on both sides of a spring-type elastic device 147 which forces permanently the drawer 142 against the tape 66 in order to place the stop 141 in slight contact with the tape 66, with a small pressure.

This pressure has been selected to allow automatic retraction of the stop 141 when the tape 66 drives an envelope 3 toward the first conveyor 69. In this case, the stop 141 is supposed to retain the following envelope.

Under the stop 141, it is provided a tongue 148. This tongue is flexible, made of high friction coefficient material, such as latex. It is supposed to retain the envelopes and especially those which incidentally, have been dragged by the first envelope which was sucked up by the tape 66.

This tongue 148 is arranged in a cavity of the drawer 142. It looks as a flexible bar maintained in fixed position by a pin 149, which is a represented on the separating device in the upward position.

The stop 141 is slightly bent downward at its end located on the side of the tape 66, forming a kind of nose assisting the folding motion at the right angle of the tongue 148. This tongue extends on one or two centimeters under the plate 141.

At the output of the extraction head, the first conveyor 69 picks up the envelopes.

Figure 8:
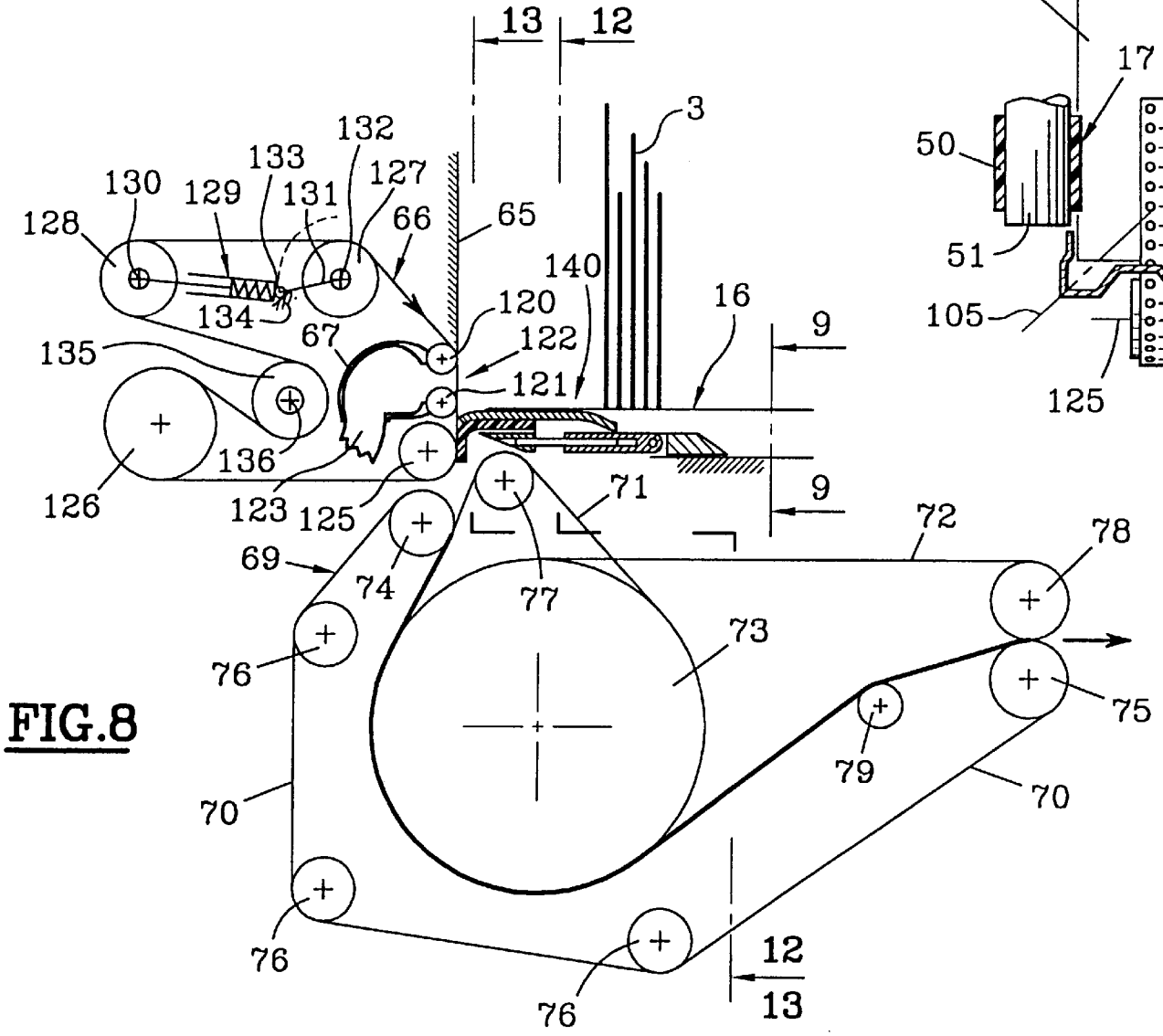
FIG. 8 is a diagrammatical view of the end of the hopper, the extraction head and the hopper.

This first conveyor, detailed previously on FIG. 8, comprises belts 70 forming, in the machine, the internal wall of the conveying line of the envelopes, and belts 71 and 72 forming the external wall.

This conveyor 69 changes direction at right angle using a drum 73.

The belt 70 is stretched between an upstream cylinder 74 and a downstream cylinder 75, and its active side winds around the drum 73.

The belt 71 is stretched between the drum 73 and a cylinder 77 arranged under the separating device 140 at the downstream end of the hopper.

The belt 72 extends between the drum 73 and a downstream cylinder 78 arranged opposite the downstream cylinder 75 of the belt 70.

The active sides of the belts 70 and 71 form, under the extraction head 9, directly aligned with the window 122, a kind of funnel 155 at the bottom of which the envelopes are vigorously pinched between the active sides of the said belts 70 and 71 arranged opposite one another.

Figure 12:
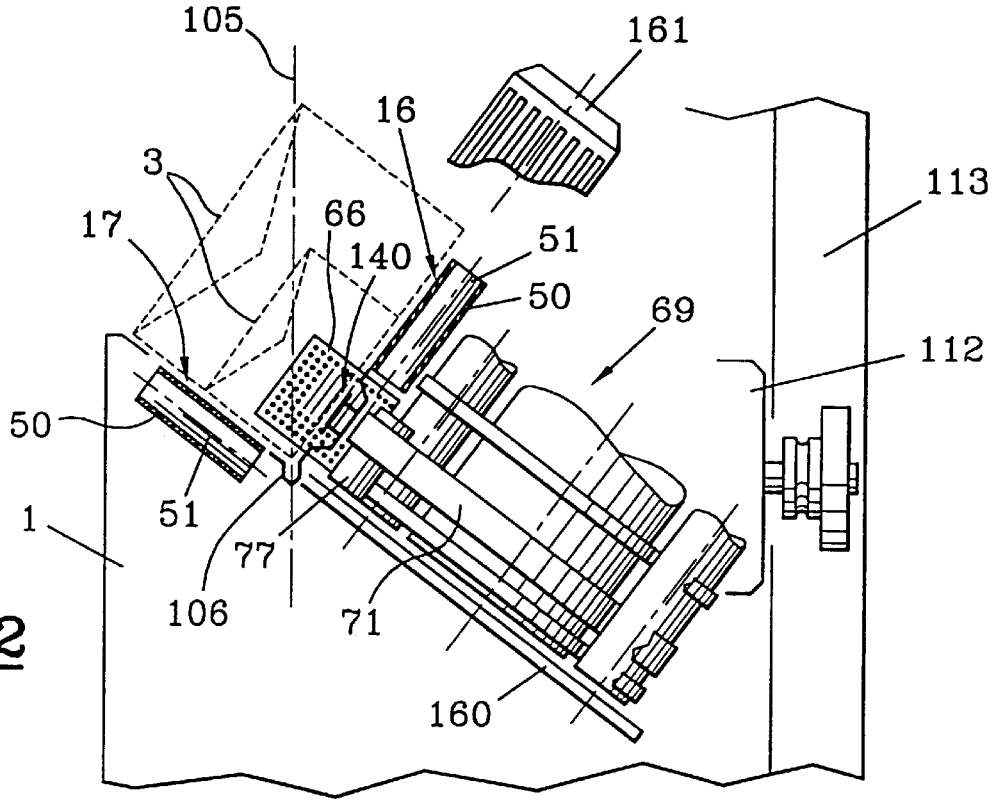
FIG. 12 is a view according to 12—12, of the FIG. 8 showing the extraction head and the first conveyor.
Figure 13:
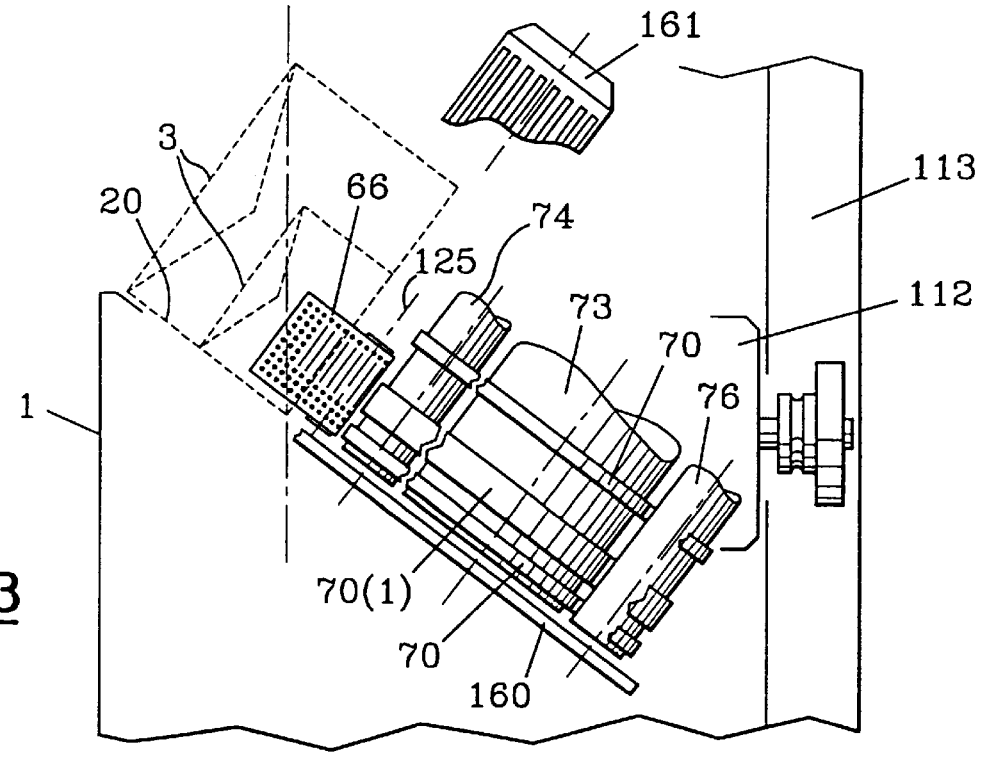
FIG. 13 is a view according to 13—13, of the FIG. 8 showing the extraction head and the first conveyor.

As represented on FIGS. 12 and 13, the belt 71 is single and it is arranged opposite one of the belts 70 winding around the cylinder 74, and especially the designated belt 70 (1).

The belt 71 is slightly wider than the other belts. The belt 70 opposite the belt 71 is as wide as the latter. This width is slightly greater than the width of the other belts 70 arranged on both sides, e.g. arranged on the side of the base edge 20 of the envelopes and, on the other side of the envelopes.

On FIG. 12, it should be noticed the separating device 140 and the section of punched tape 66 which drives the envelopes. The belt 71 is located in line with the punched tape 66, as well as the separating device 140, in order to avoid, when the envelopes are picked up by the first conveyor 69, any torque liable to place the envelopes crosswise with respect to their running direction.

The linear speeds of the first punched tape 66 and of the conveyor 69 are different so that that the envelopes are not conveyed as a tiled formation. These speed differences, with an approximate ratio of 3:1, create an interval between two successive envelopes.

In order to establish a regular interval between two envelopes, the distance D (FIG. 10) between the upper edge 156 of the window 122 and the bottom of the funnel 155, has been selected to be smaller than the minimal height h of the envelopes 3 to be sorted.

This distance D constraint enables to clear the suction window 122 at constant speed which corresponds to the speed V2 of the first conveyor 69. As soon as the window 122 is clear on a section of its height E or over its whole height, the following envelope is forced against the punched tape 66 and it is driven in turn towards the funnel 155 of the conveyor 69.

It should be noticed, on FIG. 10, that the window and especially its upper edge 156, is located at a distance d1 away from the bearing plane 16. This raised position of the window 122 with respect to the bearing plane 16 enables to benefit from the whole suction at the level of the window even when the envelope is not placed on the bearing plane 16 further to incorrect positioning. This particularity enables to tolerate a certain inaccuracy of the envelopes in the hopper and to prevent two envelopes from being sucked away at the same time.

The dimensions of the window 122 the surface of which has been selected to offer sufficient adherence and to enable accurate extraction of the envelopes from the stack impose the distance d1. This distance d1 also depends on the safety coefficient, which has been granted to take into account any inaccurate positioning of the envelopes in the hopper.

The distance d2 between the bearing surface 16 and the bottom of the funnel 155 depends on d1 and on the height h of the envelopes to be de-stacked. This height h is approximately 90 mm for conventional small format envelopes.

The lower edge of window 122 is arranged above the bearing plane 16, at a distance d corresponding to D1−E, where E corresponds to the height of the window 122. This distance d enables to take into account, as indicated previously, possible positioning defects of the envelopes with respect to the bearing plane 16. That is to say that, an envelope deviating from the bearing plane 16 by a distance d will be able to benefit all the same from the whole surface of the suction window 122, e.g. a height E, in order to be picked up by the punched tape 66 with a maximum pressure. The positioning variations of the bearing edge of the envelopes 3, in this space d, only increases the interval between two successive envelopes.

A positioning defect d' of a bearing edge of an envelope 3', as represented on FIG. 10, with respect to the bearing surface 16, causes an interval variation corresponding substantially to this offset d' multiplied by the speed ratio between the speed of the conveyor 69 and the speed of the punched tape 66.

In the absence of any positioning defects, the interval between two successive envelopes is constant. It depends on the geometrical positioning of the components and on the speed ratio between the conveyor and the punched tape of the extraction head.

The extraction accuracy of the envelopes 3 out of the hopper, by the extraction head 9 and their being picked up by the first conveyor 69 also depends on the position accuracy of both these devices.

It should be noticed, FIGS. 12 and 13, that the extraction head 9 and the first conveyor 69 are arranged on a same frame 160 similar to a plate. This frame 160 arranged in the base 1 of the machine is tilted and extends over the whole depth of the base. This frame 160 is in fact parallel to the base plane 17 of the hopper 5.

It should be noticed, FIGS. 12 and 13, represented partially, the motor 161 driving the punched tape 66 via the roller 126.

Figures 14, 15:
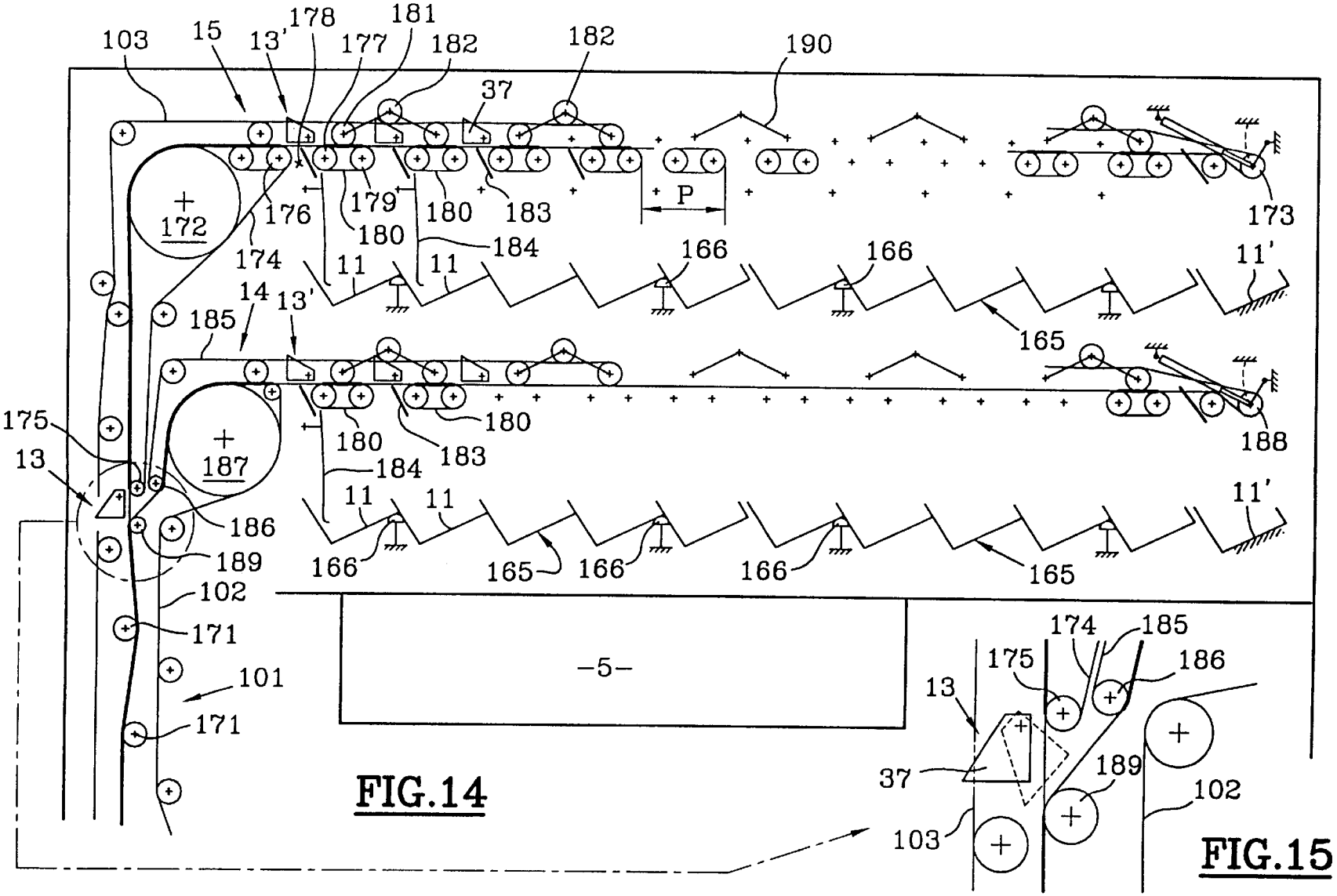
FIG. 14 is a diagrammatical representation of the devices of the upper section of the machine.
FIG. 15 is a detailed view of the area of the primary junction.

FIG. 14 is a diagrammatical representation of the upper section of the machine and especially of the conveying and distribution lines 14 and 15 which forward the envelopes or other objects in relation to their indexing code toward the appropriate pigeonholes 11.

The conveying lines 14 are located above the hopper 5 which is represented as a simple rectangle.

The pigeonholes 11 are gathered into baskets 165, whereas the baskets rest on brackets 166 by which they can be extracted out of the machine quite conveniently. The last pigeonhole 11', arranged up on the right hand side of the baskets 165, constitutes, for each conveying and distribution line, a pigeonhole enabling to accommodate the refuse e.g. the envelopes which could not be allocated because the code could not be read or for some other reason.

The conveying line 15, located at the upper section of the machine, comprises an upper wall formed by the belts 103 succeeding to the intermediate conveyor 85. These belts 103 start at the level of an upstream cylinder 104 visible on FIG. 6, arranged above the cylinder 94 of the intermediate conveyor. These belts are driven by a driving cylinder 167 located at the level of the upstream cylinder 104 and guided over pressing cylinders 171 for the rectilinear sections and, at the upper section of the machine, over a drum 172 which enables changing direction at right angle. The end of these belts 103 winds around a downstream cylinder 173 associated with a tension device detailed in relation to FIG. 16.

The lower section of the conveying line of the side 15 comprises several belts. A first belt 174 extending first of all from the primary junction 13 and is especially an upstream cylinder 175 of small diameter, down to a downstream cylinder 176 located after the drum 172. This downstream cylinder 176 forms with the following cylinder 177 a window 178 which can be designated a junction window, at the level of which the envelopes can be deviated on their rectilinear path, by junctions 13', to go back to a pigeonhole 11 according to their destination.

Each pigeonhole 11 is located opposite a junction window 178, positioned beneath and offset downward.

Between two successive windows 178, are provided two close cylinders 177, 179, and endless belts 180 whose active side, arranged at the upper section, is in contact with the active side of the belt 103.

Between the active and inactive sides of the belts 103, are provided pressure cylinders 181 acting between the cylinders 177 and 179, on the active side of the belts 180, via the active side of the belts 103. This pressure raises the nose of the envelope in order to assist it to go beyond the window 178 and to reach the following belts 180. The inactive side of the belts 103 is guided by the cylinders 181 and by upper cylinders 182.

Above each window 178, it is provided a deflecting device 37. In active deviation position, this deflecting device directs the envelope toward a deflector 183 which is fixed and tilted according to an angle approximately 45°. A flap 184 extending beneath down to the pigeonhole 11 follows the deflector 183. All these elements will also be described more in detailed in connection with FIG. 16.

The conveying and distribution line 14 comprises, for its upper wall, endless belts 185 extending between a small diameter downstream cylinder 186 located at the level of the primary junction 13 in the vertical side of the conveyor 101. The belt 185 passes over a drum 187 and extends up to the end of the machine, over a cylinder 188 also working together with a tension device detailed below on FIG. 16.

The vertical section of the conveyor 101 comprises belts 102 winding around the drum 187 of the conveying line 14. The active sides of the belts 102 force against the active sides of the belts 185 using the upstream cylinder 186 which delineates the input of the conveying line 14.

FIG. 15 represents in a more detailed way the primary junction 13. This junction starts at the level of the cylinder 189, which forms with the cylinder 186 a kind of fork. It is at the level of this cylinder 189 located just below the level of the deflecting device 37 that the active sides of the belts 102 and 103 come apart in order to supply both distribution lines 14 and 15. The new conveying and distribution line 14 consists of the belts 185 which form the upper wall, and of the upper section of the belts 102 then followed by a succession of belts 180.

The conveying and distribution line 15 consists of the belts 103 forming the upper wall and of belts 174 followed by a succession of belts 180 in order to form the lower internal wall.

Both conveying and distribution lines 14 and 15 are absolutely identical at the level of the means which enable to direct the envelopes in relation to their indexing code toward the pigeonholes 11.

Figure 16:
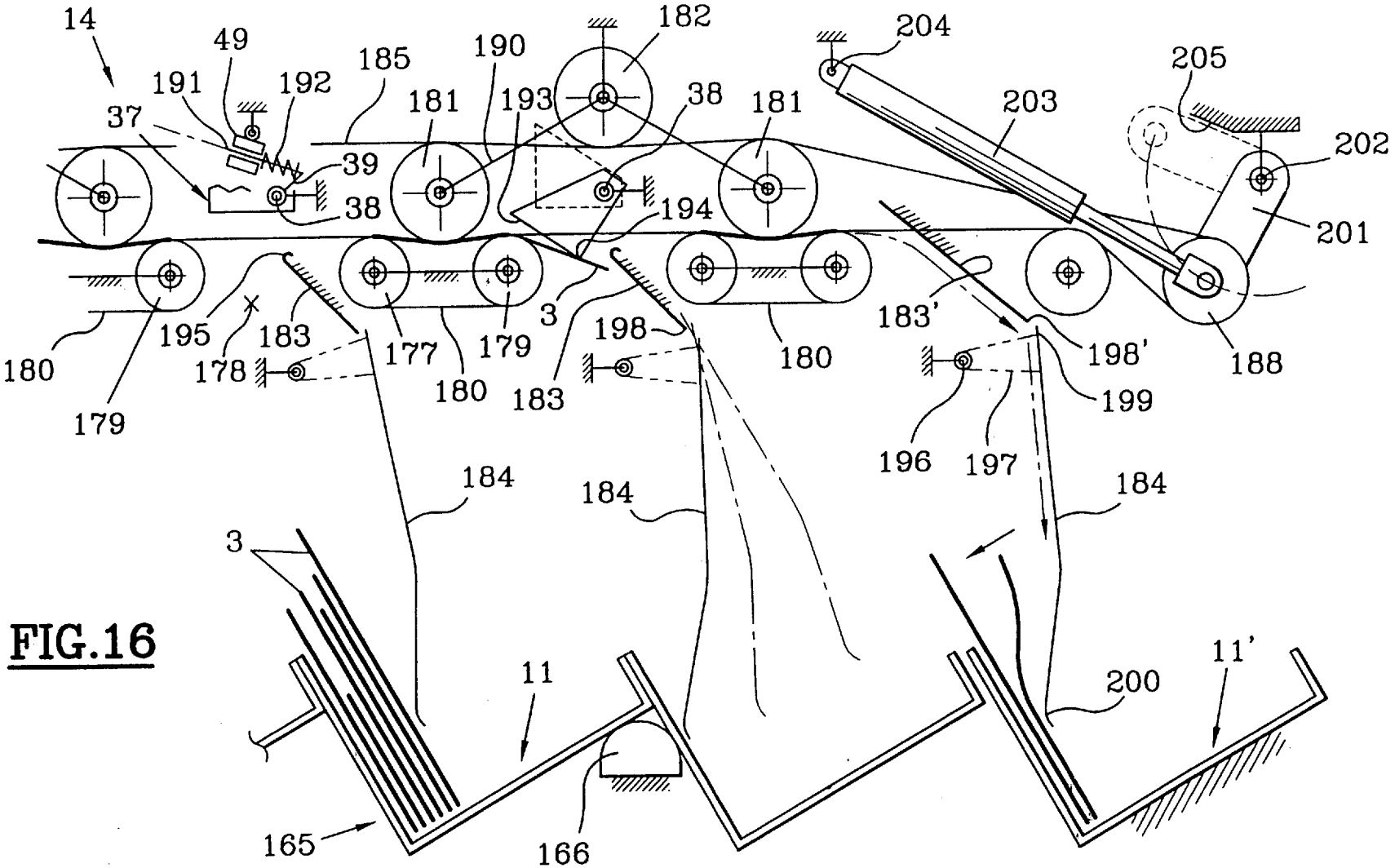
FIG. 16 represents the end of a conveying and distribution line.

FIG. 16 represents in a more detailed way the end of the conveying line 14 for instance. It is provided a basket section 165 which is placed on a bracket 166. In one of the pigeonholes 11 of the basket 165, are envelopes 3. At the end of the basket 165, is provided the refuse pigeonhole 11' which is a fixed pigeonhole into which are directed the envelopes 3 which could not be allocated to the different pigeonholes 11 for one reason or another.

The envelopes 3 arrive pinched between the active sides of the belts 185 for the upper external wall and 180 for the lower internal wall.

The path of the envelopes 3 between the upper and lower active sides of the belts is substantially rectilinear. Indeed it should be noticed that in order to go beyond the window 178, the envelope is directed upwards, forcing against the active side of the belts 185 using the rollers 181 which exert a pressure onto the active sides, between the pairs of cylinders 177 and 179 separating two successive windows 178.

Preferably, two successive cylinders 181 are centered onto the same arm forming a kind of dihedron or bogie 190 articulated at its angular section at the level of the axis of the cylinders 182 which maintain the inactive side of the belts 185.

This bogie shaped arrangement simplifies the assembly of the pressure cylinders 181 without detriment to their efficiency.

In order to leave the standard conveying horizontal line, the envelopes 3 are deviated by the deflecting device 37 which is actuated by an electromagnet 49. The deflecting device 37 is mounted on an axis 38 which is horizontal and perpendicular to the running direction of the envelopes in the conveying line. This axis is linked by a crank 39 to a rod 191 operated using the electromagnet 49. This electromagnet is monostable; return is performed by a spring 192.

The deflecting device 37 comprises a wall 193 which is interposed in the horizontal conveying line at an angle of approximately 45 degrees, in order to deviate the envelope coming and to direct it toward the deflector 183 which is located slightly retracted but parallel to the wall 193.

It should be noticed that the wall 193 is arranged upstream of the axis 38 of the deflecting device and that its home position is vertical, perpendicular to the horizontal running line of the envelopes.

The deflecting devices 37 are arranged above the active side of the belts 185 at sufficient distance so as not to disturb the passage of thicker envelopes.

The axis 38 of the deflecting device is arranged above the conveying line, downstream of the wall 193 of the deflecting device. This axis 38 is located on a plane forming with the plane of the wall 193, when it is in its active position, a dihedron whose edge corresponds to the intersection of the said wall 193 with the horizontal conveying plane and whose bisecting plane corresponds to this horizontal conveying plane.

This particularity enables to transmit the strains and loads due to the impact of the envelope 3 when it bumps into the wall 193, directly to the axis 38, thereby cancelling any torque effects at the moment of impact.

Moreover, the downstream end 194 of the wall 193 is positioned in such a way that it is situated slightly retracted from the perpendicular axis directed from the axis 38 to the envelope 3 which is deviated by the deflecting device.

Both these constructive arrangements relating to the position of the axis 38 and of the downstream edge 194 of the deflecting device operates this deflecting device in order to place it in active position or in inactive position, with a very small torque depending essentially of its inertia.

The deflector 183 comprises an input edge 195 which is situated below the level of the horizontal conveying line in order to avoid any interference with the envelopes going beyond the junction window 178.

This deflector is tilted at an angle of approximately 45 degrees and extends below the level of the inactive side of the belts 180.

When leaving the deflector 183, the envelope 3 is taken by the flap 184, which guides it, so that the envelope is placed in the pigeonhole 11 in a tidy way.

It should be noticed, as represented on FIG. 16, in the refuse pigeonhole 11', an envelope which has just been positioned in the said refuse pigeonhole 11' whereas a new envelope is directed toward the same pigeonhole. This new envelope represented in thin mixed line with an arrow, has been deviated from the conveying line using a deflector 183' blocking off radically the said conveying line.

The flap 184 is articulated at its upper section on an axis 196. This axis is positioned in front of the flap, whereas the flap comprises lateral lugs 197, which are sufficiently spaced to enable the passage of the longer envelopes 3.

The axis 196 is located beneath the lower end 198' of the deflector 183'. So, when an envelope reaches the end of the deflector 183', it strikes the flap 184, at its upper section 199, in a zone situated slightly above the axis 196.

This impact on the envelope of the flap causes the flap to pivot which tends to displace its lower end 200 so that the envelopes already arranged in the pigeonhole are compressed. It should be noticed this phenomenon in the refuse pigeonhole 11' where, under the effect of an impact at the upper section of a flap 184, the lower edge 200 of the flap forces against the last envelope inserted into the refuse pigeonhole 11' by causing this envelope to tip over rapidly and by freeing the space between the envelope and the flap which enables the new envelope which is directed towards the same refuse pigeonhole 11', to be positioned behind the other previous envelope by reaching the bottom of the pigeonhole 11, thus exploiting the return effect of the flap 184.

It is thus obtained sequential and tidy arrangement of the envelopes in the pigeonholes 11 while respecting the arrival order of the envelopes. This phenomenon is especially important when starting to fill up the pigeonholes 11 because the envelopes arrive at a great angle with respect to their bearing surface in the said pigeonholes.

The belts 185 of the conveying line 14 are guided at their upstream end over a cylinder 188. This cylinder 188 is mounted on a connecting rod 201 which is articulated on an axis 202 connected to the frame. A gas-operated jack 203 is interposed between the cylinder 188 and an axis 204 connected to the machine. The connecting rod 201 rotates around its axis 202 until it reaches a position where it is buttressed by the jack 203 on a stop 205 of the frame of the machine.

This quick release of the tension of the belts 185 enables to intervene on the conveying line to perform any operation or clear any incident such as for instance jamming incident.

The tension device described for the conveying line 14 is identical to that which is arranged at the downstream end of the conveying line 1.

Figure 17:
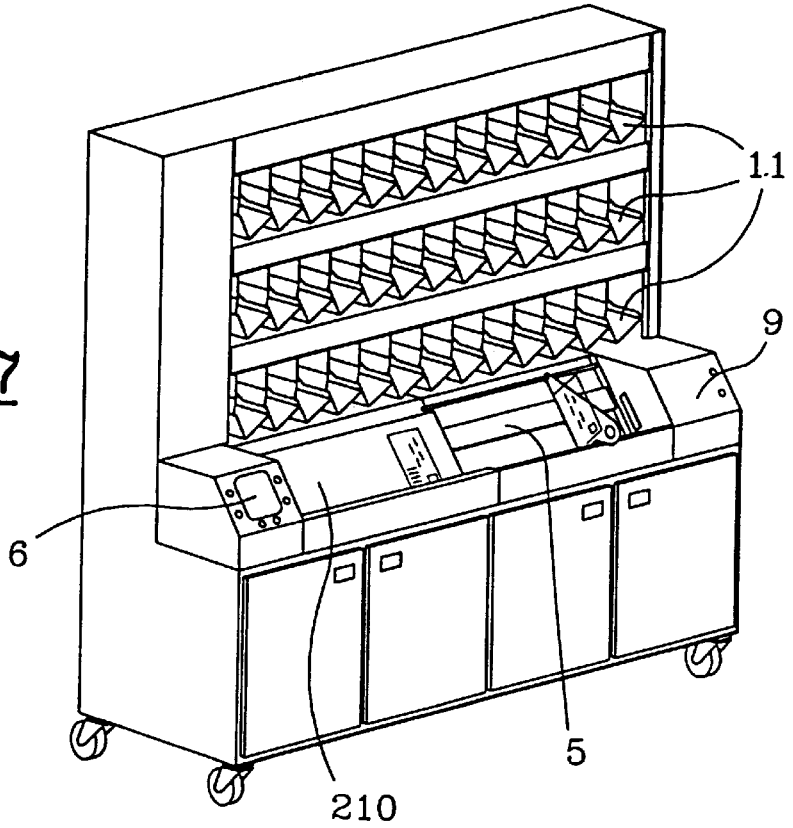
FIG. 17 represents another embodiment of the machine in which de-stacking is performed by the back of the envelopes.

FIG. 17 represents an embodiment of the machine for which the number of pigeonholes 11 is greater. The pigeonholes are distributed over three levels instead of two levels, and the length of each level is greater than that of the machine represented on FIG. 1.

Moreover, according to this configuration, the control desk 6 and the extraction head 9 are arranged as reversed with respect to the machine described previously. The control desk is arranged on the same side as the vertical section of the forwarding conveyor, which is located in the left-hand section of the machine.

The extraction head is located on the right-hand side of the hopper and of the machine and the envelopes are picked up by their backs and not by their fronts as previously. This particularity enables to improve clearing the tiling incidents during de-stacking.

The hopper extends over a greater width, below the pigeonholes 11. This hopper comprises a dynamic section 5 identical to that described previously and a static section 210 consisting of a single sheet folded at right angle and arranged in the alignment of the dynamic hopper 5.

The operator thus benefits from a large capacity for sorting, storing and preparing the envelopes.

With this configuration, this assembly consisting of the dynamic hopper 5 and of the extraction head 9 constitutes a kind of module. This modularity enables to construct even larger capacity machines as represented on FIG. 18.

The machine can be extended using an additional module which comprises the assembly consisting of the dynamic hopper 5 and of the extraction head 9. The static hopper 210 extends over a large section of the machine beneath the pigeonholes 11. The operator has therefore ample room to prepare his packets or stacks.

Figure 18:
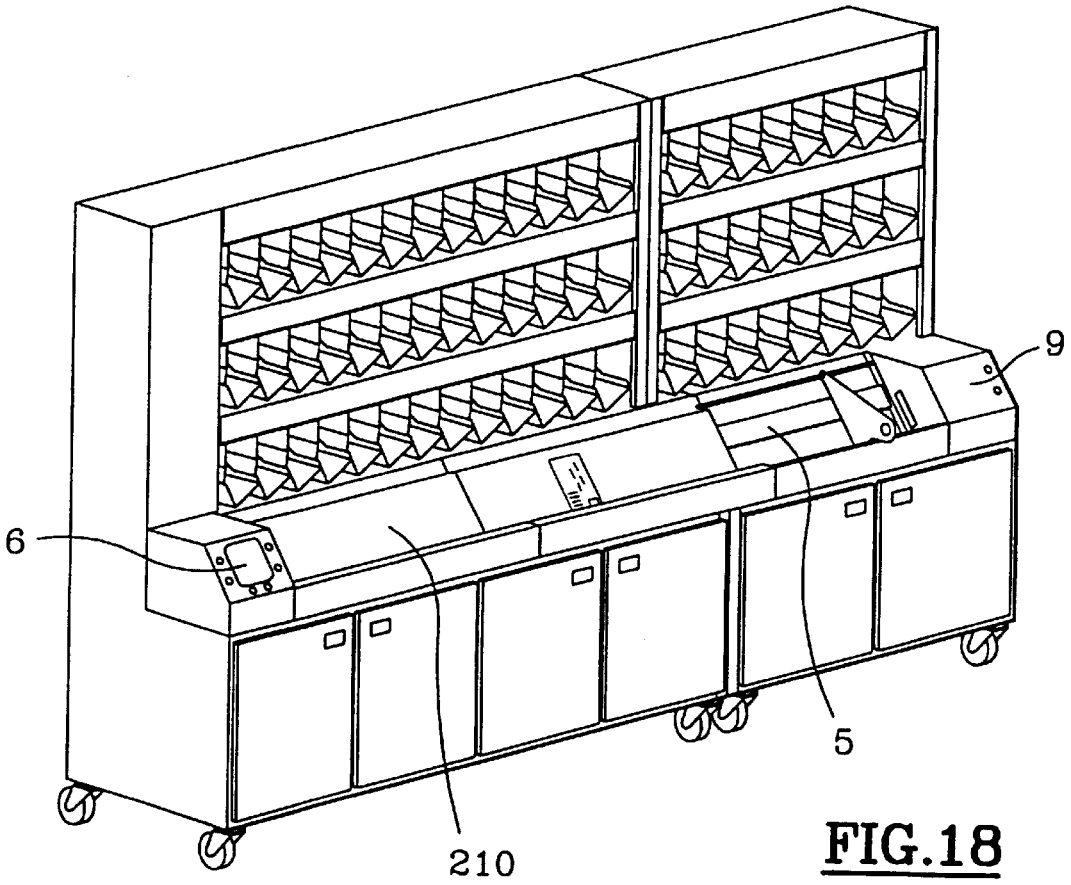
FIG. 18 represents an alternative of FIG. 17 which shows the modular possibilities of the machine in order to increase its capacities.
Figures 19, 20:
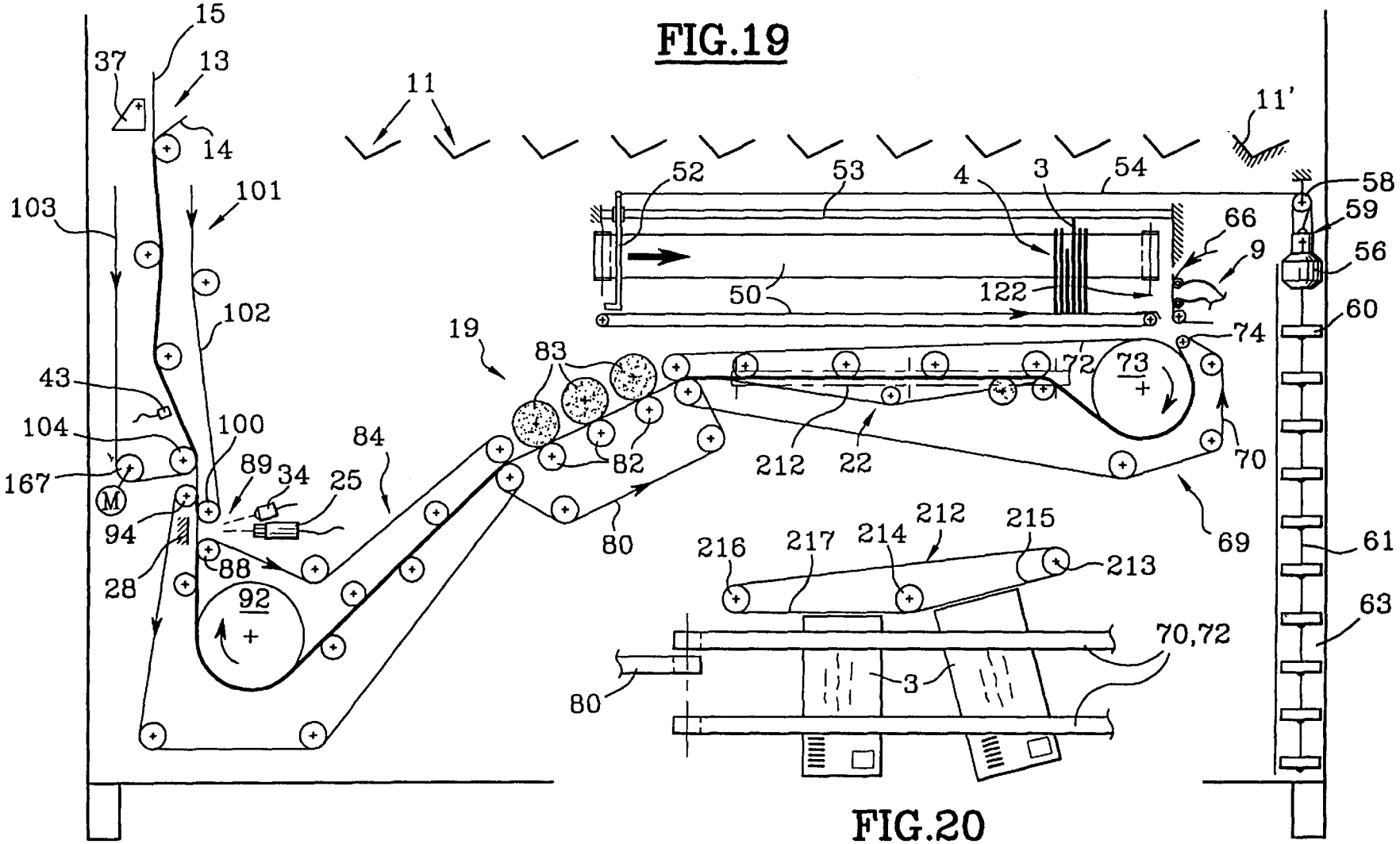
FIG. 19 represents the devices arranged in the lower caisson of the machines illustrated on FIGS. 17 and 18.
FIG. 20 represents, in a more detailed way, an embodiment variation of the re-jogging system.

FIG. 19 is a diagrammatical representation of the disposition and configuration of the lower section of the machines according to the embodiments shown on FIGS. 17 and 18. This FIG. 19 constitutes in fact an alternative of the previous FIG. 6 whereas the similar items and disposition have been kept.

The left-hand section of the machine has remained unchanged, as well as the conveyors, which supply the different levels of pigeonholes 11.

The modifications are due to the extraction head 9 being arranged on the right hand side of the dynamic hopper 5. The hopper properly speaking has remained unchanged. It still exhibits the form of a horizontally tilted dihedron. The pusher 52 moves the envelopes from left to right in order to bring them to the endless punched tape 66, at the level of the suction window 122. The first conveyor 69 which comprises, in its downstream section, the re-jogging device 22 picks up the envelopes. The envelopes are then lifted up in the twisting module 19 and picked up again by the intermediate conveyor 84 which brings them to the reading head comprising particularly the camera 25.

The re-jogging device 22, detailed on FIG. 20, comprises a wall perpendicular to the forwarding plane of the envelopes, which consists of an endless tape 212 whose active side moves at the same speed as the belts 70 and 72 of the first conveyor. This endless tape 212 is guided using cylinders, which are arranged in pairs in planes forming a dihedron. Between the upstream cylinder 213 and the central cylinder 214, the active side 215 converges to the forwarding belts. Between the central cylinder 214 and the downstream cylinder 216, the active side 217 is parallel to the forwarding belts. The envelopes 3 are slightly pinched between the belts 70, 72.

We claim:

1. A machine for sorting envelopes, comprising:

a hopper that receives envelopes to be sorted, said hopper comprising a bearing surface in a bearing plane and a reference surface in a reference plane, said bearing and reference planes intersecting to form a dihedral angle whose line of intersection is in a horizontal plane when the machine is arranged for operation, said bearing plane being inclined relative to the horizontal plane at a first angle and said reference plane being inclined relative to the horizontal plane at a second angle less than said first angle;

an extraction head at one end of said hopper that is arranged to extract from said hopper one envelope at a time having one side at said second angle;

at least two horizontal tiers of pigeonholes above and recessed relative to said hopper that are arranged to store sorted envelopes with one side in a vertical plane, said at least two horizontal tiers of pigeonholes being one above the other and each comprising a plurality of said pigeonholes; and a conveyor system that conveys envelopes from said extraction head to respective said pigeonholes in all of said tiers, said conveyor system comprising a first conveyor that is arranged to convey from said extraction head envelopes having the one side at said second angle, a twisting module that is arranged to receive envelopes from said first conveyor and to reorient the envelopes from having the one side at said second angle to having the one side in the vertical plane, an intermediate conveyor that is arranged to receive envelopes from said twisting module and that conveys envelopes to a side of the machine, a reader that is arranged to receive envelopes from said intermediate conveyor and to determine said pigeonholes to which envelopes are to be routed, and a distribution conveyor that is arranged to convey envelopes from said reader to said pigeonholes and that comprises a first envelope movement path that is substantially vertical and plural second envelope movement paths that are substantially horizontal and that each conveys envelopes from said first envelope movement path to respective said pigeonholes.

2. The machine of claim 1, wherein said second angle is from 30° to 40°.

3. The machine of claim 1, wherein each of said reference and bearing surfaces comprises an endless belt for conveying envelopes.

4. The machine of claim 1, wherein said hopper comprises a pusher on a guide rail, said pusher comprising an envelope pushing surface and a primary weighted body that urges said pushing surface with a constant force and a plural secondary weighted bodies that urge said pushing surface with a force proportional to a distance of said pushing surface from said extraction head.

5. The machine of claim 1, wherein said extraction head comprises a suction nozzle and an endless tape with a sequence of holes therein through which said suction nozzle acts on envelopes at said one end of said hopper.

6. The machine of claim 5, wherein said extraction head comprises a pair of intermeshed belts that form a V-shape that is arranged to receive envelopes from said suction nozzle.

7. The machine of claim 1, wherein said twisting module comprises a first belt of circular cross section and plural castors opposing respective plural rollers.

8. The machine of claim 1, wherein said intermediate conveyor comprises a first pair of belts that are an external wall of an envelope conveying line and second pair of belts opposing said first pair of belts that are an internal wall of the envelope conveying line.

9. The machine of claim 8, wherein said intermediate conveyor further comprises a re-jogger that aligns envelopes, and wherein said re-jogger comprises a separator that, separates one belt of said second pair of belts from the opposing one belt of said first pair of belts without separating a second belt of said second pair of belts from the opposing second belt of said first pair of belts.

10. The machine of claim 1, comprising three of said tiers of pigeonholes.

11. The machine of claim 1, wherein said reader comprises means for reading an index code on an envelope.

12. The machine of claim 11, wherein said reader comprises a monitor and control means for converting information from an index code to a location of one of said pigeonholes and for tracking movement of said distribution conveyor.

13. The machine of claim 12, wherein said distribution conveyor comprises plural junctions for switching envelopes from said first envelope movement path to one of said second envelope movement paths responsive to said monitor and control means.

14. The machine of claim 11, wherein said means for reading comprises a filtered lamp for illuminating a window that is arranged to expose an index code when an envelope is being read by said reader, and a CCD equipped camera for reading the exposed index code.

15. The machine of claim 14, wherein said window comprises an opening with a reflector therein for providing an image to said camera when an envelope is not being read.

16. The machine of claim 14, wherein said window comprises an opening with light emitting diodes therein for tracking envelope movement through said reader.

* * * * *